US008002943B2

(12) United States Patent
Brown et al.

(10) Patent No.: US 8,002,943 B2
(45) **Date of Patent: *Aug. 23, 2011**

(54) MANUFACTURING PROCESS AND SYSTEM FOR FLOOR TILE

(75) Inventors: Ronald H. Brown, Holland, MI (US); Anthony McConnell, Zeeland, MI (US); Randolph Woellper, Hudsonville, MI (US)

(73) Assignee: Haworth, Inc., Holland, MI (US)

( * ) Notice: Subject to any disclaimer, the term of this patent is extended or adjusted under 35 U.S.C. 154(b) by 709 days.

This patent is subject to a terminal disclaimer.

(21) Appl. No.: 12/154,363

(22) Filed: May 22, 2008

(65) Prior Publication Data

US 2009/0085251 A1 Apr. 2, 2009

Related U.S. Application Data

(63) Continuation-in-part of application No. 11/998,881, filed on Dec. 3, 2007, now Pat. No. 7,810,299.

(60) Provisional application No. 60/997,023, filed on Sep. 28, 2007.

(51) Int. Cl.
*E04F 15/024* (2006.01)

(52) U.S. Cl. ..... 156/304.1; 156/153; 52/747.11; 52/747.12

(58) Field of Classification Search ..... 156/153, 156/304.1; 428/44, 45, 48, 49; 52/385, 390, 52/747.11, 747.12

See application file for complete search history.

(56) References Cited

U.S. PATENT DOCUMENTS

| | | | | |
|---|---|---|---|---|
| 3,271,917 | A | 9/1966 | Rubenstein | |
| 4,035,967 | A | 7/1977 | Harvey | |
| 4,085,557 | A | 4/1978 | Tharp | |
| 4,390,580 | A | 6/1983 | Donovan | |
| 4,447,998 | A | 5/1984 | Griffin | |
| 4,621,468 | A | 11/1986 | Likozar | |
| 4,719,727 | A | 1/1988 | Cooper | |
| 4,729,859 | A | 3/1988 | Munsey | |
| 4,914,881 | A | 4/1990 | Spork | |
| 4,931,331 | A * | 6/1990 | Owens | 428/47 |
| 4,944,130 | A | 7/1990 | Pallhorn | |
| 4,996,804 | A | 3/1991 | Naka | |
| 5,057,355 | A | 10/1991 | Klingelhofer | |
| 5,088,251 | A | 2/1992 | Hazeldine | |
| 5,111,627 | A | 5/1992 | Brown | |
| 5,333,423 | A | 8/1994 | Propst | |
| 5,398,466 | A | 3/1995 | Oyama | |
| 5,904,009 | A | 5/1999 | Huang | |
| 6,418,697 | B1 | 7/2002 | Da Molin | |
| 6,800,174 | B2 * | 10/2004 | Gregg et al. | 156/346 |
| 6,911,248 | B2 * | 6/2005 | Sabatini | 428/119 |
| 6,918,217 | B2 | 7/2005 | Jakob-Bamberg | |
| 2003/0097808 | A1 | 5/2003 | Sabatini | |
| 2006/0144005 | A1 | 7/2006 | Tonyan | |

* cited by examiner

*Primary Examiner* — Khnh Nguyen
*Assistant Examiner* — John Blades
(74) *Attorney, Agent, or Firm* — Flynn, Thiel, Boutell & Tanis, P.C.

(57) ABSTRACT

A floor tile for a raised floor. The floor tile is defined by a shallow upwardly-opening metal pan defining a shallow compartment in which a main preformed one-piece concrete block is secured. The main concrete block is preferably formed from a plurality of one-piece preformed concrete sub-blocks which are adhesively adhered in sideward abutting relationship to define a plan profile corresponding to the main concrete block. The main concrete block is then adhesively secured within the compartment of the metal pan.

17 Claims, 16 Drawing Sheets

SUB-BLOCK COLLATION PROCESS & ARRANGEMENT

FLOOR TILE ASSEMBLY PROCESSES & ARRANGEMENT

MANUFACTURING PROCESS AND SYSTEM FOR FLOOR TILE

CROSS REFERENCE TO RELATED APPLICATION

This application claims the benefit of U.S. Provisional Application No. 60/997 023, filed Sep. 28, 2007, the entire disclosure of which is incorporated herein by reference.

This application is a continuation-in-part of application Ser. No. 11/998,881, filed Dec. 3, 2007 now U.S. Pat. No. 7,810,299, as owned by the Assignee hereof, and the entire disclosure of which is incorporated herein by reference.

FIELD OF THE INVENTION

This invention relates to improvements with respect to a raised floor system, including improvements relative to floor tiles, and specifically improvements relative to a process and system for manufacturing floor tiles.

BACKGROUND OF THE INVENTION

A significant variety of raised floor systems have been developed for use in commercial buildings. Such systems typically employ a plurality of height-adjustable pedestals supported on a main floor in a grid-like arrangement, and a plurality of removable floor tiles supported on the upper ends of the pedestals. The floor tiles are formed using numerous construction techniques, with one common technique employing a formed sheet metal pan defining an upwardly opening compartment which is filled with concrete. The space below the raised floor is utilized for accommodating cabling such as power, data and communication cabling, and in addition accommodates or defines ducts for heating, ventilating and air conditioning (HVAC).

In known floor systems employing composite steel and concrete floor tiles, which tiles in plan view are typically relatively large squares having side dimensions of about 24 inches, the tiles due to their construction and size are necessarily both bulky and heavy so that transport of such tiles over long distances is undesirably costly. Also, since the tiles are normally formed utilizing at least partially automated machinery capable of filling, leveling, curing and finishing the concrete, this normally mandates that the tiles be produced in rather large quantities at a centralized manufacturing location. Further, filling the metal pans with wet concrete and achieving a proper structural interconnection of the hardened concrete to the metal pan so as to provide the finished floor tile, when in use, with the necessary strength and durability, has presented an ongoing problem.

In a continuing development effort to improve the strength and durability of the floor tiles and specifically the structural connection of the concrete to the metal pan, the metal pan is typically provided with protrusions or barbs, particularly associated with the horizontal bottom wall of the pan, which protrude upwardly into the concrete poured into the pan in an effort to increase structural strength and structural interconnection of the concrete to the pan. While these techniques have proven to improve the strength characteristics, these techniques also increase the complexities associated both with the manufacture of the pan and the forming of the concrete therein.

In addition to the above, floor tiles of the type utilizing a wet concrete mix poured into a metal pan also typically utilize gypsum cement to create the wet concrete mix. This, however, creates additional disadvantages due not only to the expense of gypsum cement, but also due to its characteristics. Specifically, concrete mix formed using gypsum cement experiences dimensional instability in that the concrete dimensionally changes, specifically grows, during drying or curing. This hence creates significant dimensional instability with respect to the finished floor tile, and requires significant grinding or surface finishing of the exposed upper surface of the concrete in order to achieve the desired finished dimension of the floor tile. In addition, since wet concrete mix formed using gypsum cement requires utilization of a significant quantity of water, this reduces the strength properties of the concrete. Nevertheless, gypsum cement is typically utilized since curing of the concrete can be accomplished over a shorter number of days, typically three to four days, in contrast to the longer curing time of Portland cement, typically about seven days. Even so, this technique of forming floor tiles by depositing wet concrete mix into preformed metal pans is undesirable with respect to the time and space requirements demanded for production of such floor tiles, and hence this technique is limited to situations where these restrictions and the limitations imposed on the volume of production can be tolerated.

As an alternative to the manufacturing technique wherein wet concrete is poured into and cured within a metal pan, and the disadvantages associated with such technique, other floor tiles have been manufactured wherein a preformed block, frequently of wood, is positioned within a metal pan and secured therein, and is typically wholly enclosed within the pan by means of a separate covering or top walls. Such constructions, however, typically lack the strength and durability achieved utilizing floor tiles formed dominantly of concrete.

While attempts have been made to design and develop floor tiles employing a concrete block positioned within a metal pan by preforming the concrete and then forming the pan therearound, such as by shaping or bending the pan around a preformed block, such technique is also undesirable in terms of its processing limitations and the difficulty in achieving desired dimensional tolerances.

Examples of known constructions of raised floor arrangements, and specifically the floor tiles and pedestals associated therewith, are illustrated by U.S. Pat. Nos. 4,085,557, 4621,468, 4,719727, 4,914,881, 4,944,130, 5,057,355, 5,088,251, 5,333,423, 5,904,009, 6,418,697, 6,918,217 and 2003/097808 A1.

Accordingly, it is an object of this invention to provide an improved manufacturing process and manufacturing system for a floor tile for a raised floor system, which floor tile specifically involves a composite construction wherein a preformed concrete core or block is confined within a formed metal pan, with the construction of the floor tile providing structural fixation of the concrete block to the metal pan so as to provide significantly improved structural characteristics and integrity, while at the same time permitting the forming and utilization of a metal pan which is free of protrusions or the like which complicate the construction and configuration of the pan.

It is also an object of the present invention to provide an improved manufacturing process for the floor tile, as aforesaid, specifically with respect to the manner in which the concrete and metal pan are formed and secured together.

It is a further object of the invention to provide an improved manufacturing process for a floor tile, as aforesaid, wherein the tile, employing the preformed concrete block positioned in and adhered to a preformed metal pan, provides improvements with respect to strength of the resultant floor tile and at the same time permits the floor tile to be manufactured with less process time, while at the same time avoiding the undesired material variations, environmental variations and process control issues typically encountered when forming floor tiles using a wet concrete mix poured into the pan.

It is a still further object of the invention to provide an improved floor tile manufacturing process, as aforesaid, which avoids the manufacturing cycle limitations, namely time limitations, associated with conventional manufacturing processes which involve pouring wet concrete mix into preformed metal pans.

It is another object of the invention is to provide an improved floor tile for a raised floor, and the process of making the floor tile, wherein the concrete mix which is utilized for defining the block is effectively a dry mix, that is, a mix of concrete and aggregate which utilizes minimal water so as to permit forming and curing of the concrete block as a preform in a minimal period of time, with the preform thereafter being positioned in and adhesively adhered to the preformed metal pan.

A still further object of the invention is to provide a floor tile forming process, as aforesaid, which utilizes Portland cement for the dry concrete mix to achieve reduced material cost and material stability during drying or curing, with the overall curing time being significantly reduced by forming of the preformed concrete blocks from the dry concrete mix.

Still a further object of the invention is to provide a floor tile forming process, as aforesaid, which in a partially or fully automated manner permits floor tiles of uniform properties and consistencies to be efficiently manufactured at a very high rate, requiring minimal manual supervision and operation, and resulting in efficiencies of production and uniformity of end product.

Other objects and purposes of the invention will be apparent upon reading the following specification and inspecting the accompanying drawings.

SUMMARY OF THE INVENTION

In accordance with a preferred construction and manufacturing process for a floor tile according to the present invention, the floor tile is primarily of a two-piece construction defined by a shallow upwardly-opening metal pan defining a shallow compartment therein in which a main preformed one-piece concrete block is stationarily secured. The metal pan has upwardly protruding side walls formed with top hems or flanges which protrude downwardly over the exterior surfaces thereof. The corners of the pan are provided with slits which protrude downwardly from upper edges of the side walls, whereby the side walls can be resiliently angularly deflected outwardly upon application of a force thereto. The main preformed concrete block is preferably formed from a plurality (preferably three) of one-piece preformed concrete sub-blocks which are preferably identical, with a predetermined number of sub-blocks being positioned in sideward abutting relationship to define a plan profile corresponding to the main concrete block. One or both opposed side edges of the sub-blocks are coated with an adhesive, such as a hot melt, and are then pressed and held in abutting contact so as to fixedly and rigidly join the sub-blocks together to create the main one-piece concrete block. The main concrete block is then adhesively secured within the compartment of the metal pan, with the latter preferably being accomplished by coating the bottom surface of the main concrete block with adhesive, and by coating the inner surfaces of the pan side walls with adhesive. The pan side walls are deflected outwardly to permit proper disposition of the main concrete block within the compartment of the pan and allow the pan and concrete block to be pressed together to create a secure fixed bonded relationship between the main concrete block and the bottom wall of the pan. The side walls of the pan are also deflected inwardly so as to press against and adhesively and fixedly secure to the side or edge faces of the main concrete block. The resulting floor tile can then have the exposed upper surface of the concrete block treated as appropriate, such as by grinding the upper surface to provide a desired smoothness and appearance, with the floor tile then being suitable for use as part of a raised floor system.

The invention also relates to a process for forming a floor tile for a raised floor system, including the steps of providing a mold defining therein a plurality of mold cavities disposed in sidewardly spaced but adjacent relationship with the individual cavities being disposed in upright relation relative to the mold; molding a plurality of generally rectangular concrete blocks within the mold cavities; removing the molded blocks from the mold while maintaining the blocks in a grouping wherein the blocks are in the same spatial relationship defined by the mold cavities, and allowing the blocks to cure; compressing the grouping of blocks sidewardly into a bundle wherein the blocks are in sideward abutting contact with one another; feeding the bundle of blocks past a grinder to effect surface finishing of the lengthwise-extending edge faces of the blocks as defined on one side of the bundle; feeding the bundle of blocks past a grinder to effect surface finishing of the lengthwise-extending edge faces of the blocks as defined on the other side of the bundle; then separating the individual blocks from the bundle and vertically rotating the individual blocks from an upright position into a generally flat horizontal position; then sequentially feeding the blocks into a collating station and, at said collating station, moving a predetermined number of blocks into sidewardly abutting contact to define a block set which has a generally rectangular profile in plan view; advancing the block set from the collating station to an adhesive station and applying adhesive to one or both of the opposed edge faces as defined between adjacent blocks; pressing the blocks together to permit the adhesive to set-up and fixedly join the blocks of the set together to define a single one-piece rigid main block; providing a box-shaped support pan having a shallow upwardly-opening compartment defined by a bottom wall of the pan and upright side walls which join to edges of the bottom wall and protrude upwardly therefrom; applying adhesive to one of (1) the bottom surface of said preformed main concrete block and (2) the inside surface of the pan bottom wall; positioning the preformed main concrete block into said compartment of said pan so that the bottom surface of said main concrete block contacts the pan bottom wall; and pressing the block and pan together to allow the adhesive at contact areas between the pan bottom wall and the bottom surface of the main concrete block to cure so as to effect fixed securement of the block to and within the pan.

The invention further relates to a process for forming a floor tile for a raised floor system including the steps of: providing a plurality of molded concrete sub-blocks; supplying said sub-blocks to a collating station; organizing a predetermined number of said sub-blocks, at said collating station, into a block set wherein the predetermined number of sub-blocks are disposed in sideward abutting contact and define an overall geometric arrangement having a generally rectangular plan-view profile corresponding to a desired main block; movably displacing the collated block set from the collating station to a displacement station whereat the sidewardly-contacting pairs of blocks are slightly sidewardly displaced to create gaps between the opposed pairs of abutting edge faces; applying adhesive into each of the gaps and onto at least one of the edge faces of each opposed pair;

relatively displacing the blocks back into their original position wherein all of the opposed edge faces of adjacent blocks are again disposed in flush contacting engagement, and pressing the blocks sidewardly together to permit the adhesive between the edge faces of the blocks to set up and fixedly join the sub-blocks together to define a one-piece main block; forwarding the main block to an adhesive station, and applying an adhesive over substantially the entirety of only one of the exposed top and bottom surfaces of the main block; providing a box-shaped metal support pan having a shallow upwardly-opening compartment defined by a bottom wall of the pan and upright side walls which join to and protrude upwardly from edges of the bottom wall; positioning the block and pan in generally opposed relationship, and then relatively moving the block into the compartment of the pan to cause the adhesive-coated main surface on the block to contact the bottom wall of the pan; and pressing the pan and block together while allowing the adhesive to set up and effect fixed securement of the block to the bottom wall of the pan.

The invention still further relates to a process for forming a floor tile for a raised floor system, including the steps of providing a box-shaped support pan having a shallow upwardly-opening compartment defined by a bottom wall of the pan and upright side walls which join to edges of the bottom wall and protrude upwardly therefrom; providing a plurality of one-piece concrete sub-blocks having a thickness which equals or slightly exceeds the depth of the shallow compartment; positioning a predetermined number of preformed concrete sub-blocks in horizontally adjacent side by side relationship so that the sub-blocks, when opposed edge faces of the sub-blocks are sidewardly engaged with one another, define a plan-view profile which substantially corresponds to a plan-view profile of the compartment; applying a first band of a first adhesive to at least one edge face of each opposed pair of edge faces as defined on said sidewardly adjacent sub-blocks; substantially simultaneously with the above, applying a second band of a second adhesive to at least one edge face of each opposed pair of edge faces as defined on said sidewardly adjacent sub-blocks, said first and second bands as initially applied being sidewardly spaced from one another, and said first and second adhesives being different with said first adhesive having a shorter setting time and said second adhesive having a higher bonding strength; pressing said sub-blocks sidewardly together to permit setting up of at least said first adhesive to effect fixed securement of said sub-blocks at said opposed contacting side faces so as to define a preformed one-piece main concrete block having a plan view profile which substantially corresponds to said compartment; applying adhesive to one of (1) the bottom surface of said preformed main concrete block and (2) the inner surface of said pan bottom wall; positioning the preformed main concrete block into the compartment of the pan so that the bottom surface of the main concrete block contacts the pan bottom wall; and pressing the concrete block and pan together and allowing the adhesive at contact areas between the pan bottom wall and the bottom surface of the main concrete block to effect fixed securement of the main concrete block to and within the pan.

Figure 1:
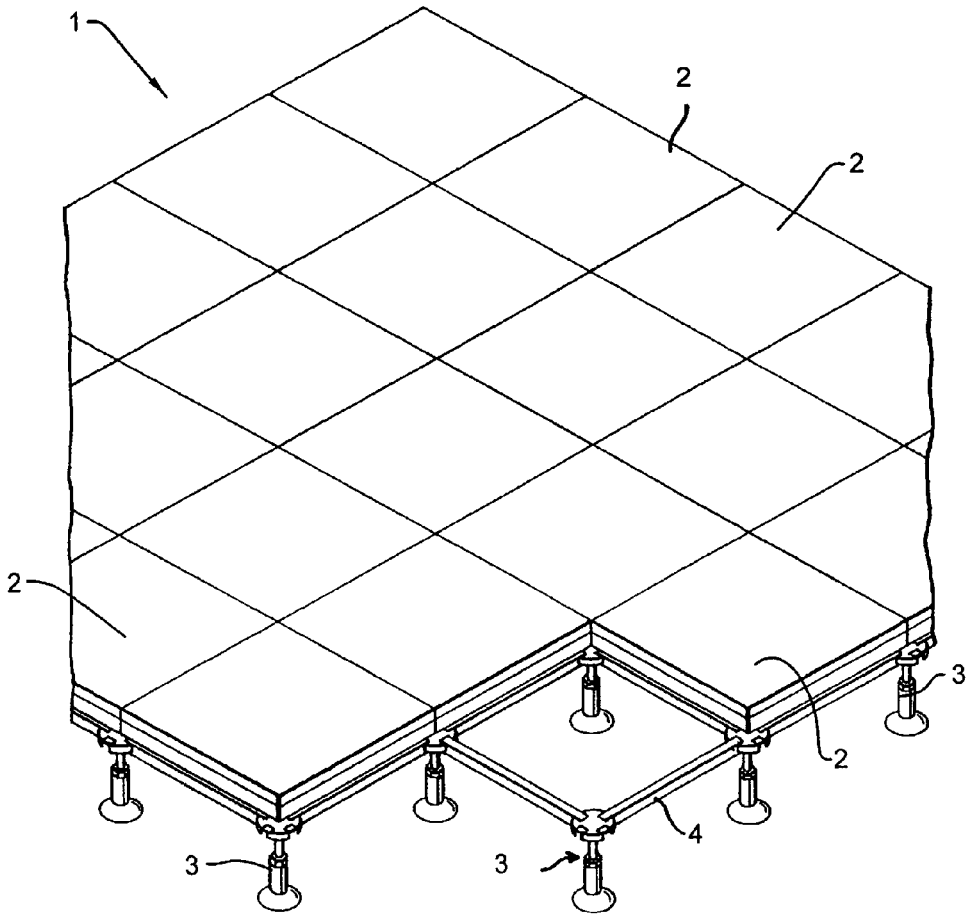
FIG. 1 (PRIOR ART)
FIG. 1 is a fragmentary perspective view illustrative of a conventional raised floor system.
Figure 2:
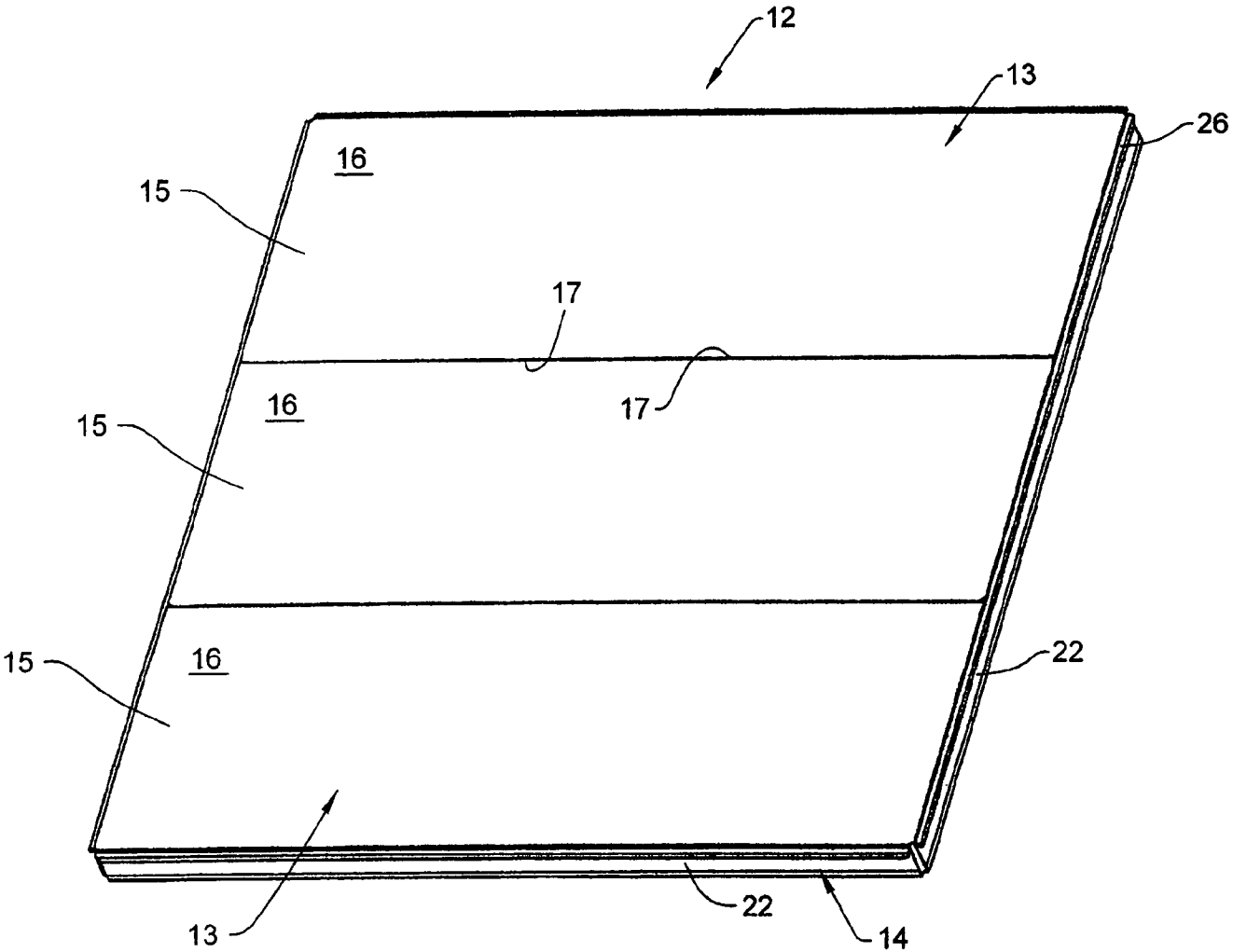
FIG. 2 is a perspective view of an improved floor tile for a raised floor in accordance with the present invention.
Figure 3:
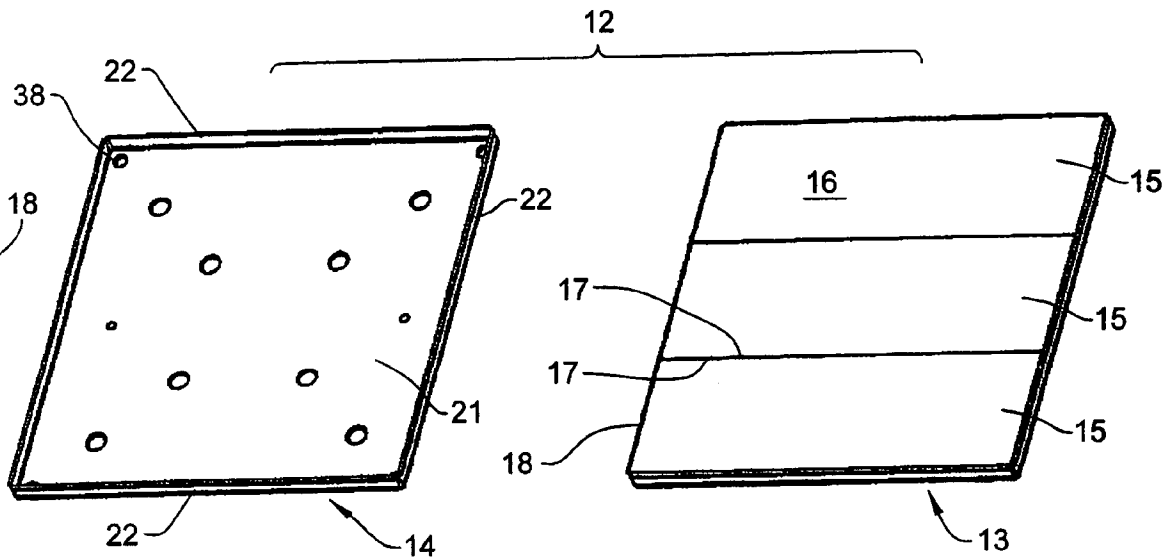
FIG. 3 is an exploded perspective view of the floor tile illustrated in FIG. 2.

Certain terminology will be used in the following description for convenience and reference only, and will not be limiting. For example, the words "upwardly", "downwardly", "rightwardly" and "leftwardly" will refer to directions in the drawings to which reference is made. The words "upwardly" and "downwardly" will also refer to directions associated with the floor when installed over a subfloor. The words "inwardly" and "outwardly" will refer to directions toward and away from, respectively, the geometric center of the arrangement and designated parts thereof. The word "forwardly" will be used to refer to the normal direction of movement of a work piece, such as a concrete block or a metal pan, forwardly in the normal manufacturing and/or assembly direction. Said terminology will include the words specifically mentioned, derivatives thereof, and words of similar import.

DETAILED DESCRIPTION

Referring to FIG. 1, there is illustrated a somewhat conventional raised floor arrangement 1 defined by a plurality of generally square removable floor tiles 2, the latter being supported on a plurality of upright pedestals 3 which are typically arranged in uniformly spaced relationship within rows and columns to define a grid, whereby each pedestal typically cooperates with the corners of up to four floor tiles. The arrangement of FIG. 1 also illustrates horizontally elongate stringers or rails 4 extending between and joined to adjacent pedestals 3, which stringers are frequently utilized to provide supportive engagement for the edge of the floor tiles, although in many systems the stringers are eliminated and the floor tiles are supported entirely by the pedestals. The conventional arrangement of a raised floor as diagrammatically depicted by FIG. 1 is solely for background purposes, and it will be understood that the improved floor system of the present invention as described hereinafter includes similar cooperative relationships when assembled to define a raised floor.

Referring now to FIGS. 2-11, there is illustrated a preferred embodiment of a floor tile 12 constructed in accordance with the present invention for use in defining a raised floor. The floor tile 12 is primarily of a metal and concrete composite construction, and is defined principally by a main one-piece concrete block or core 13 confined within a shallow upwardly-opening box-shaped metal pan 14.

The main one-piece concrete block 13 is a preform created from a plurality of one-piece preformed concrete sub-blocks 15. The sub-blocks 15 are preferably of identical configuration, and a predetermined number of sub-blocks 15, three in the illustrated and preferred embodiment, are disposed in a configuration (i.e. a square) to define the outer plan-view profile of the main block 13, and are then fixedly joined together as by adhesively securing the opposed abutting edge faces 17 so that the plurality of sub-blocks 15 define a rigid one-piece construction.

Figure 4:
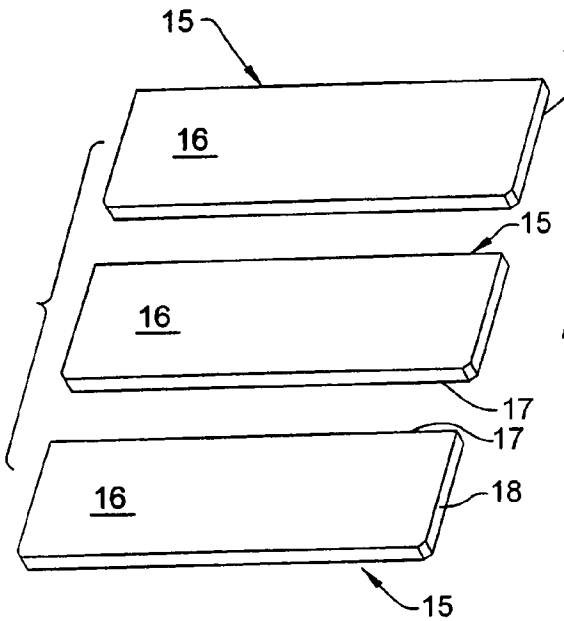
FIG. 4 is an exploded perspective view illustrating the preformed sub-blocks utilized for forming the preformed main block utilized in the tile of FIG. 3.
Figure 9:
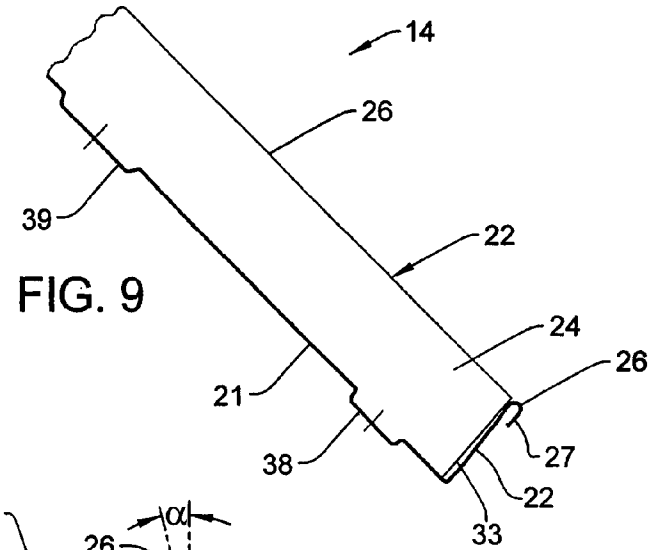
FIG. 9 is an enlarged fragmentary sectional view taken generally along line 9-9 in FIG. 5.

As illustrated by FIG. 4, in the preferred construction the three identical preformed sub-blocks 15 are each of generally rectangular configuration in plan view, and are disposed in side-by-side relationship so that the opposed elongate side faces 17 are in directly opposed relationship. A suitable adhesive such as a conventional hot melt is applied to one or both opposed side faces 17 of the concrete sub-blocks 15, whereupon the three sub-blocks 15 are then moved horizontally into sidewardly abutting and contacting relationship to define a generally square profile. The sub-blocks 15 are appropriately held in pressed together relationship for a sufficient period of time to enable the adhesive between the contacting faces 17 to solidify (i.e. cure) and create a rigid securement of the three sub-blocks 15 together to hence define the one-piece preformed main block 12. As thus created, the main block 12 has the desired configuration, namely a square plan profile, with the block 12 having generally flat and parallel top and bottom faces 16 and 19, respectively.

The one-piece preformed concrete main block 12 is adapted to be positioned within the box-shaped metal pan 14 which, as illustrated by FIGS. 5-10, is defined by a generally horizontally planar bottom wall 21 which, adjacent edges thereof, is joined to upwardly protruding edge or side walls 22 which cooperate with the bottom wall to define an upwardly-facing shallow compartment 20 in which the preformed main block 12 is positionable.

Figure 7:
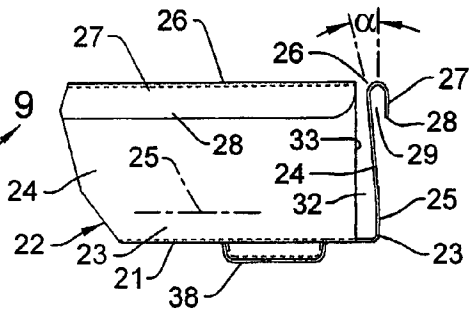
FIG. 7 is an enlarged fragmentary view showing the corner of the pan illustrated in FIG. 6.
Figure 5:
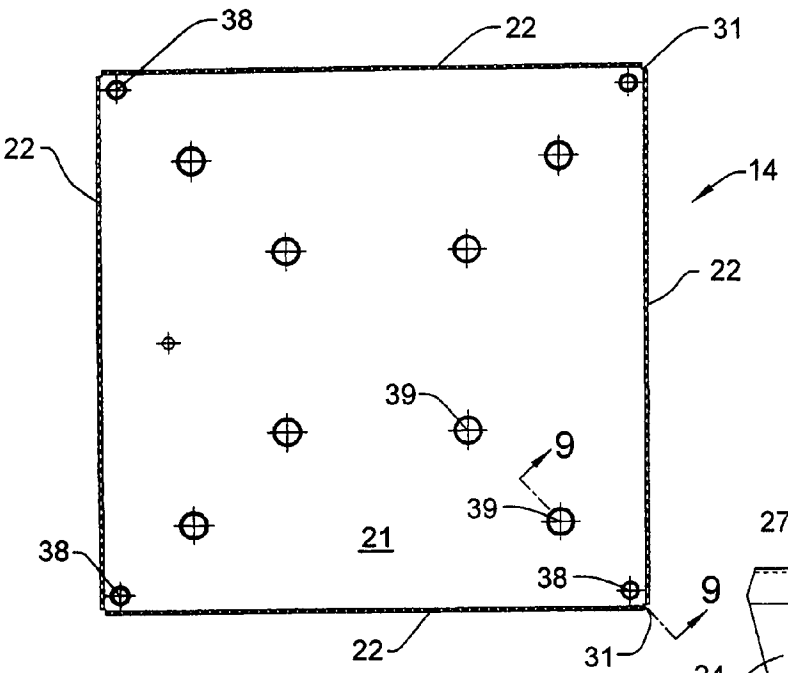
FIG. 5 is a top or plan view of the metal pan used in the construction of the floor tile according to a preferred embodiment of the present invention.
Figure 6:
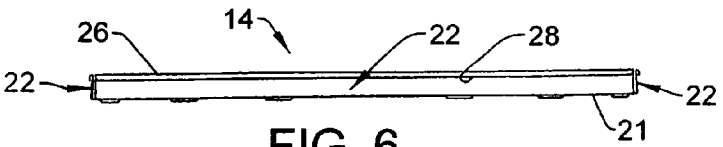
FIG. 6 is a side elevational view of the pan illustrated in FIG. 5.
Figure 8:
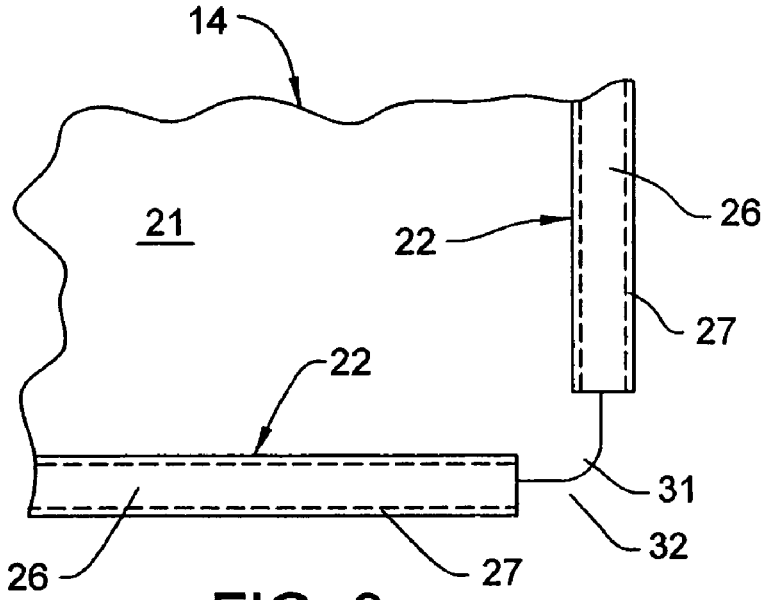
FIG. 8 is an enlarged fragmentary top view of the corner portion of the metal pan shown in FIG. 7.
Figure 10:
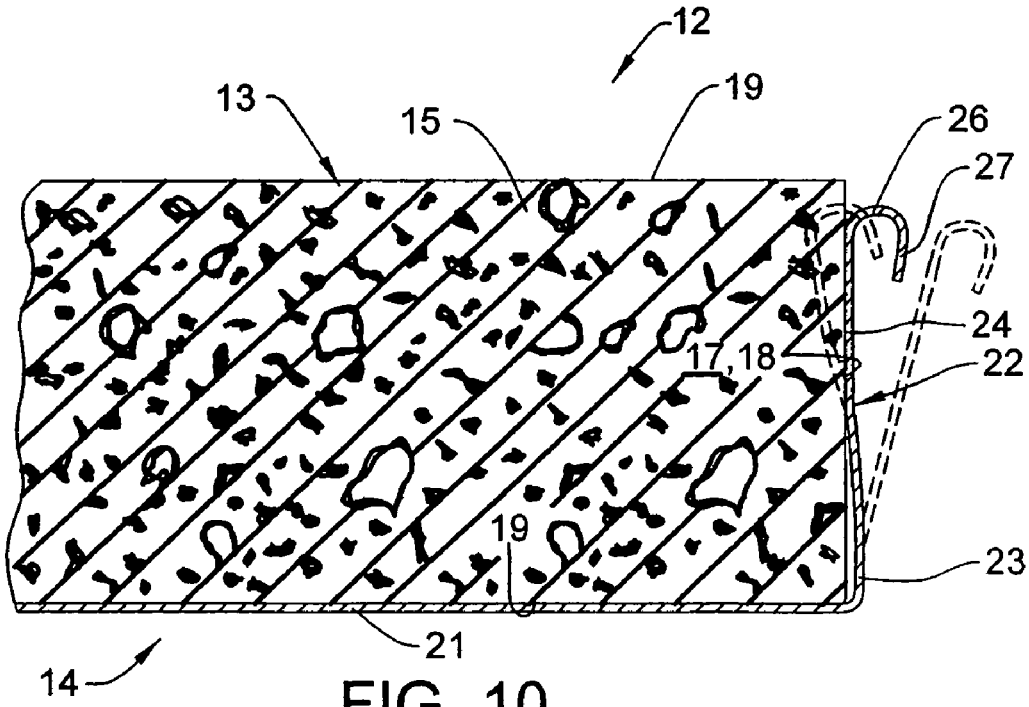
FIG. 10 is an enlarged fragmentary sectional view showing the preformed concrete block secured within the metal pan, and also showing the initial and deflected positions of the pan side wall which exist prior to and during installation of the preformed concrete block.
Figure 11:
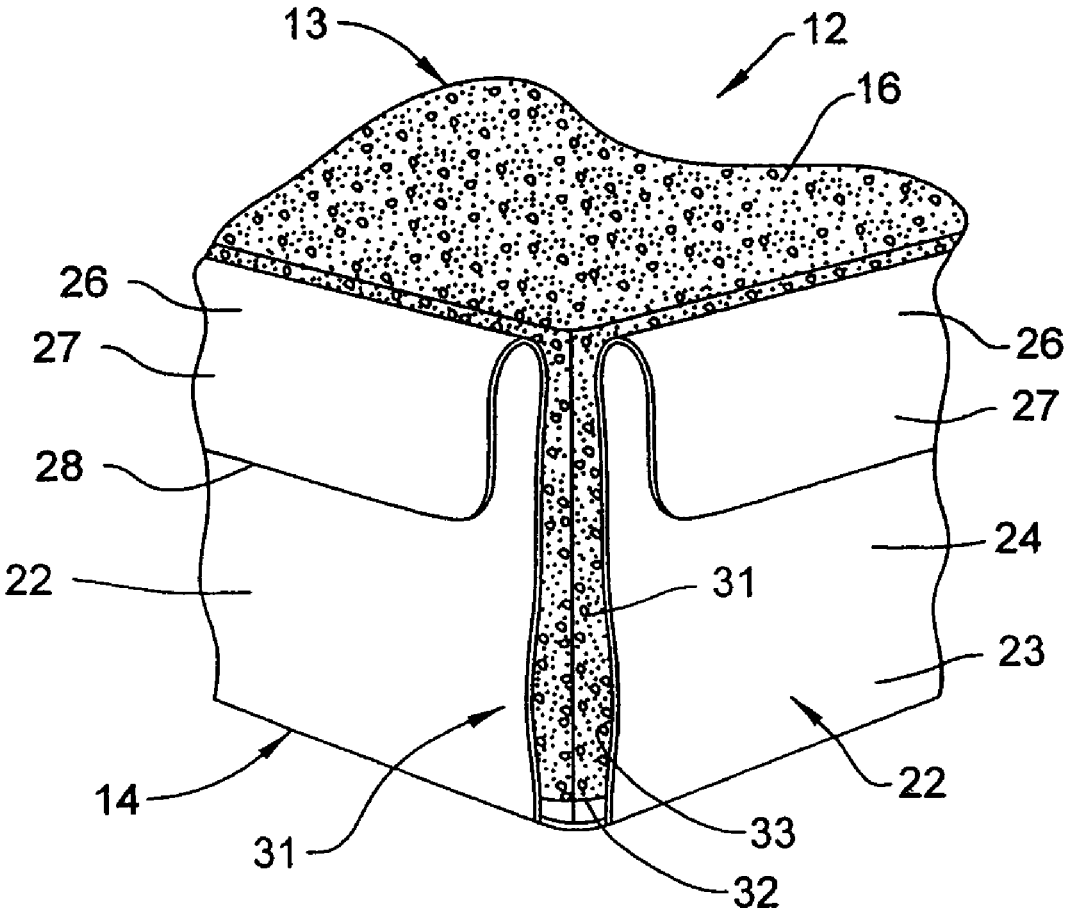
FIG. 11 is a fragmentary perspective view, taken partially from above, and showing a corner of the assembled floor tile.

Each pan side wall 22, as illustrated by FIGS. 7 and 10, has a lower wall part 23 which protrudes upwardly from the bottom wall 21 in generally perpendicular relationship therewith. Lower wall part 23 joins to an upper wall part 24 which is cantilevered upwardly at a slight angle relative to the vertical, which angle is inclined slightly inwardly toward the interior of the pan compartment. This upper wall part 24 joins to the lower wall part 23 generally at a bend or flex line 25 which extends throughout the length of the respective side wall. This upwardly cantilevered side wall 22, adjacent its upper edge, is provided with a reverse bend 26 creating a hem or flange part 27 which protrudes downwardly a limited extent in overlapping relationship to the exterior surface of the respective side wall 22. The hem or flange 27 terminates in a lower free edge 28 which is spaced upwardly a substantial distance from the bottom of the pan. The flange 27 cooperates with the side wall 22 to define a downwardly-opening groove or channel 29 therebetween.

The pan 14, at each of the upright corners 31 thereof, is provided with a slit or slot 32 which opens downwardly from the upper edge of the side walls 22. This slit or slot is terminated and defined by the end edges 33 of the adjacent upright side walls 22.

The pan 14 also has positioning projections 38 formed in and protruding downwardly from the bottom wall 21, with one such positioning projection 38 being positioned in close proximity to and slightly inwardly spaced from each of the pan corners 34. The positioning projection 38 is in the illustrated embodiment formed generally as a downwardly displaced cylindrical or conical projection, and is preferably deformed downwardly from the bottom wall of the pan in such manner as to prevent formation of any openings or cracks in the bottom wall. The positioning projections 38 are exposed, shaped and sized to cooperate with positioning recesses associated with the support pedestals.

The bottom wall 21 of pan 14 may also be provided with one or more stiffening projections 39 formed therein, which are also preferably downwardly deformed from the bottom wall 21 so as to be free of any openings through the bottom wall, while at the same time providing the bottom wall with increased stiffness.

The metal pan 14 is preferably formed from thin metal, typically steel sheet, and can be suitably shaped utilizing conventional forming techniques such as stamping, roll forming or the like. The shaping of the pan 14 is such, however, that the side walls 22 are normally slightly inwardly angularly inclined as they project upwardly, as depicted by the angle $\alpha$ in FIG. 7, with these side walls 22 being grippable, as by use of the hem 27, so as to be angularly deflected outwardly into a position wherein they are slightly outwardly inclined relative to the vertical, substantially as illustrated by the dotted line position shown in FIG. 10. The outward deflection of the side walls 22 facilitates the positioning of the one-piece concrete main block 13 within the pan during assembly therebetween, with release of the outwardly deflected side walls 22 enabling the side walls to resiliently spring inwardly into gripping contacting engagement with the edge faces 17 and 18 of the main block 13.

Figure 12:
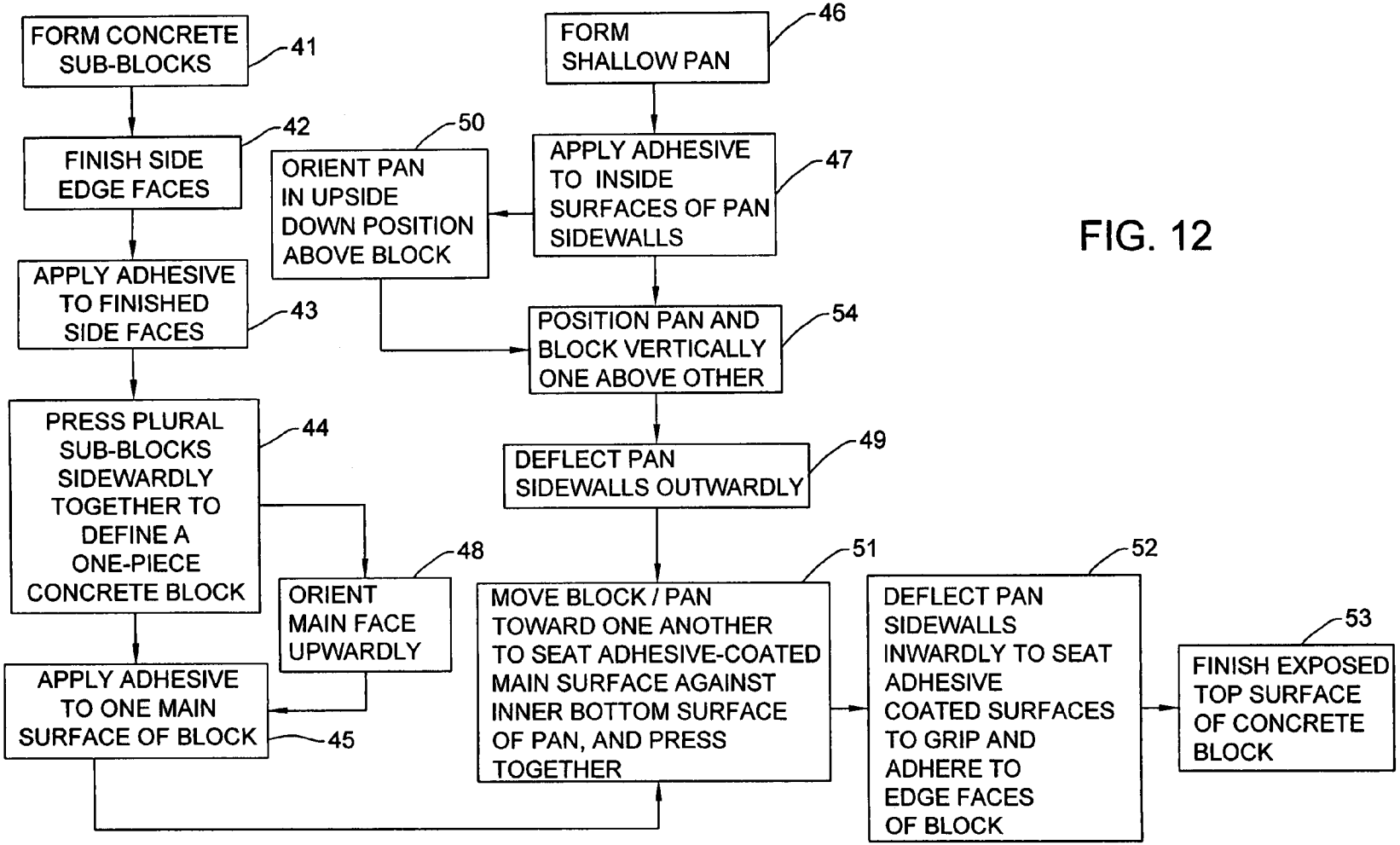
FIG. 12 is a flow diagram which illustrates the forming process for the floor tile illustrated in FIGS. 2-11.

Referring now to FIG. 12, there is diagrammatically illustrated a preferred manufacturing process for the floor tile 12. As indicated at step 41, the concrete sub-blocks 15 are initially preformed. These sub-blocks 15 are then preferably subjected to an edge finishing (step 42), namely grinding of the side edge faces 17 to provide improved surface uniformity and flatness. The side faces 17 then have adhesive applied or sprayed thereto as indicated at step 43, which adhesive is applied only to those selected edge faces 17 which are directly opposed to one another when the plural (i.e. three) sub-blocks 15 are disposed in generally co-planar side-by-side relationship. At step 44 the three sub-blocks 15 are then pressed together so that the adhesively-coated long edge faces 17 contact one another and the sub-blocks define a generally square profile. The sub-blocks 15 are pressed together for a sufficient period of time to enable the adhesive to dry and create a secure rigid structural joint between the sub-blocks to hence create the one-piece main block 13. The corners of the block are then chamfered, as by grinding, to create small flats extending angularly across the corners. The main block 13, as indicated at step 48, is preferably oriented so that the bottom wall 19 is oriented upwardly, following which (at step 45) an adhesive is applied over the entire upwardly-oriented bottom surface 19 of the main block.

Simultaneous with or prior to the above block forming steps, the shallow metal pan 14 is formed at step 46, and adhesive (i.e. hot melt) is applied to inside surfaces of the pan side walls as indicated at step 47. The pan, as indicated at step 48, is preferably oriented in an upside down relationship, i.e., oriented so that the compartment thereof opens downwardly, and the side walls 22 of the pan are engaged, such as by gripping the hems 27 on the pan, and are deflected outwardly as indicated at step 49. With the pan and adhesive-coated block oriented vertically one above the other, specifically with the pan oriented above the block, the pan is moved downwardly (step 51) to telescope over the block 13, which downward movement continues until the adhesively coated upwardly-facing bottom surface 19 of the block contacts the bottom wall of the pan, following which the pan and block are pressed together to allow the adhesive to set up and create a fixed securement of the block to the bottom wall of the pan.

After the block has been telescopically fitted into the pan as indicated at step 51, the side walls of the pan are released or deflected inwardly (step 52) so that they return back towards their original position so as to grippingly engage the edge faces of the block. Since the inner surfaces of the pan side walls 22 have adhesive applied thereto, the adhesive is pressed into contact with the edge faces of the block 13 and creates a rigid securement between the pan edge walls 22 and the edge faces of the block. After the block has been appropriately adhesively fixed within the pan throughout both the bottom and side walls thereof, the composite floor tile construction can then be moved to a finishing station, such as indicated at step 53, to permit grinding of the exposed top surface 16 of the concrete block 13 to create the desired smoothness and appearance.

In the preferred manufacturing process for the floor tile 12 as described above relative to FIG. 12, the adhesive securement between the bottom surface 19 of the block and the opposed bottom wall 21 of the pan is preferably achieved by initially applying a coating of adhesive directly to the exposed bottom surface 19 of the block 13 prior to positioning of the block within the pan compartment. By applying the adhesive directly to the bottom surface 19 of the main block, the adhesive is able to more readily coat and adhere to the entirety of the bottom surface 19, which surface necessarily involves some degree of roughness and porosity due to its having been formed from a concrete mix. This more intimate coating of the bottom surface 19 with the adhesive, when the adhesive coated bottom surface is pressed into contact with the bottom wall 21 of the pan, then provides for a more uniform and extensive coating of adhesive being pressed into intimate contact between the entire surface area of both the block bottom surface 19 and the bottom pan wall 21. As the adhesive cures and solidifies, the adhesive hence creates a very strong and rigid securement between the pan bottom wall 21 and the bottom surface 19 of the block 13 which extends over substantially the entirety of the bottom surface 19. The area of surface adherement and the quality of the adherement is hence significantly improved and thereby provides highly improved rigid securement of the concrete block 13 within the pan 14.

While the coating of the bottom surface 19 of the block with adhesive is believed all that is necessary in order to achieve a proper adhesive securement with the bottom wall of the pan, it will be appreciated that, if felt necessary or desired, the upper surface of the pan bottom wall 21 could also have an adhesive coating applied thereto, such as a hot-melt sprayed thereon.

As to the adhesive coating which is applied between the block edge faces 17 and the pan side walls 22, this adhesive coating is preferably provided on the inside surfaces of the pan side walls 22 prior to fitting of the block 13 within the pan compartment 20, and the block edge faces in this preferred process are not adhesively coated. By avoiding direct application of adhesive to the edge faces of the block, this minimizes the possibility of excess adhesive being accidentally squeezed outwardly so as to project upwardly beyond the upper edge of the block, particularly since the upper edge of the block is spaced upwardly a small distance above the top edge of the pan side walls 22. Excess or extra cleanup of the floor pan due to excess or undesired adhesive being extruded out or passing beyond the upper edges of the block is hence avoided or at least greatly minimized.

In addition, by applying the adhesive to the inside surfaces of the pan side walls 22, but not to the edge faces of the block, and by outwardly angularly deflecting the pan side walls 22 prior to insertion of the block 13 into the pan compartment 20, this minimizes the possibility of adhesive being scraped upwardly beyond the upper edges of the block during assembly of the block into the pan.

More specifically, when the inverted pan 14 is moved downwardly so as to be telescoped over the inverted block 13, as described above, the manner of cooperation between the edge faces of the block and the deflected side walls 22 of the pan is such as to prevent or minimize any tendency for the adhesive on the side walls to be scraped off during the positioning of the pan and block in engagement with one another. If any such contact occurs between the pan and block as the pan telescopes downwardly over the block, such contact will likely occur between the pan side walls and the bottom edge of the block, which hence would tend to displace any adhesive toward the bottom of the pan (and specifically away from the exposed top face of the block) so as to trap any such adhesive in the lower corners or edges of the pan.

Further, when the pan side walls 22 are released and moved into gripping engagement with the block, the inclined configuration of the pan side walls, namely their slight inward incline, tends to squeeze any excess adhesive downwardly toward the bottom of the pan, rather than outwardly toward the upper surface of the block, thereby minimizing escape of adhesive from the upper edge of the pan.

The process as described above is hence believed to optimize the fixation strength of the adhesive attachment between the block and the pan, particularly with respect to the rigid securement of the bottom surface of the block to the pan bottom wall so as to provide significant reinforcement for the bottom of the block to hence withstand the otherwise damaging tension forces which are created adjacent the bottom surfaces due to the vertical downward loading imposed on the block. At the same time, this process minimizes the escape of adhesive and hence minimizes any necessary or required subsequent cleanup due to escape of adhesive.

In the present invention, the adhesive for creating a fixed securement between the metal pan and the concrete block is preferably a conventional thermosetting hot melt, such as a urethane adhesive, which hot melt is typically and preferably applied to the respective surfaces by spraying.

The floor pan construction and manufacturing process in accordance with the preferred embodiment of the invention, particularly as illustrated and described above with respect to FIGS. 2-12, is particularly desirable with respect to providing increased efficiencies relative to the manufacturing of the floor tile while at the same time maintaining or providing improved strength characteristics while permitting utilization of a simplified configuration and construction of both the concrete block and pan. In particular, since the concrete block associated with the pan (such as the main block 13) is typically a 24 inch by 24 inch square, such large block, if initially molded in one piece, is difficult and time consuming to mold and to handle subsequent to molding since its size greatly restricts not only the rate of molding, but also the subsequent handling required to position and secure the block within the preformed metal pan. On the other hand, in the present invention the sub-blocks in accordance with the preferred embodiment are approximately 8 inches by 24 inches, whereby the three sub-blocks when adhesively fixed together result in the desired 24 inch by 24 inch square main block. The smaller sub-blocks, however, permit forming of large quantities of sub-blocks within a block molding machine which includes a large number of mold cavities oriented in an upright manner so that the 8 inch width of the sub-block is oriented in an upright direction. In this manner, the sub-block can be properly molded in an upright condition within the block molding machine due to the smaller height of the sub-block, while at the same time a molding machine of reasonably small size and space has the capability of simultaneously molding, in a single operation, a large number of sub-blocks. Further, when the plurality of sub-blocks are discharged from the machine, they can be maintained in adjacent upright relationship so as to permit drying and subsequent handling, while again minimizing the overall space requirements and the size of associated machinery and equipment needed for handling the sub-blocks. The overall net effect is a substantial increase in productivity, specifically the number of overall blocks which can be manufactured, relative to the size, space and speed with which the 24-inch square blocks can be molded in accordance with prior known technologies.

To create the preformed sub-blocks as described above, the concrete mix preferably utilizes Portland cement both due to its lower cost and its dimensional stability, and the concrete mix, i.e., Portland cement, aggregate, water and other conventional fillers, when poured into the mold is preferably in a condition conventionally referred to as "dry mix" in that a minimum quantity of water (typically a maximum of 10 percent by weight) is utilized and this improves the strength of the finished sub-block and greatly minimizes the drying or curing time, such as by reducing the curing time from several days to about one day or less. The "dry mix" also permits the formed but non-cured blocks to be rapidly removed from the mold so as to maximize the production rate of the mold, with the formed but non-cured blocks when removed from the mold being supported in an upright condition while they undergo their remaining curing phase, resulting in a faster production rate while minimizing storage or floor space for support of the blocks during the curing phase. The overall production rate is thus significantly increased so as to be suitable for high volume production.

With the improved floor tile and manufacturing process of this invention as described above, the preformed concrete block in a conventional construction will typically have a thickness of about 1⅛ inch. In situations where greater floor loads are anticipated and higher strengths are required, however, the block thickness can be increased, such as up to about 1½ inches, by modifying the width of the mold cavities within the mold machine. The thicker preformed blocks, however, may fit within the same or thicker pan and can be adhesively fixedly secured within the pan in the same manner described above. This manufacturing process, and mechanical design of the floor tile, hence readily permits selective variation, at least within a permissible range, in the thickness of the concrete block and in the resulting thickness of the floor tile so as to optimize floor tile strength relative to anticipated external loads.

Reference will now be made to FIGS. 13, 14A-C, 15A-B and 16A-C which illustrate a preferred and generally automated manufacturing arrangement and process for permitting rapid and efficient manufacture of floor tiles constructed in accordance with the present invention. More specifically, the floor tiles and specifically the arrangement and process depicted by FIGS. 13-16, as described hereinafter, incorporate therein the desirable constructional features possessed by the floor tile illustrated and described above with respect to FIGS. 2-11, and also incorporate therein the desirable manufacturing process depicted by the flow chart of FIG. 12 as above described.

Figure 13:
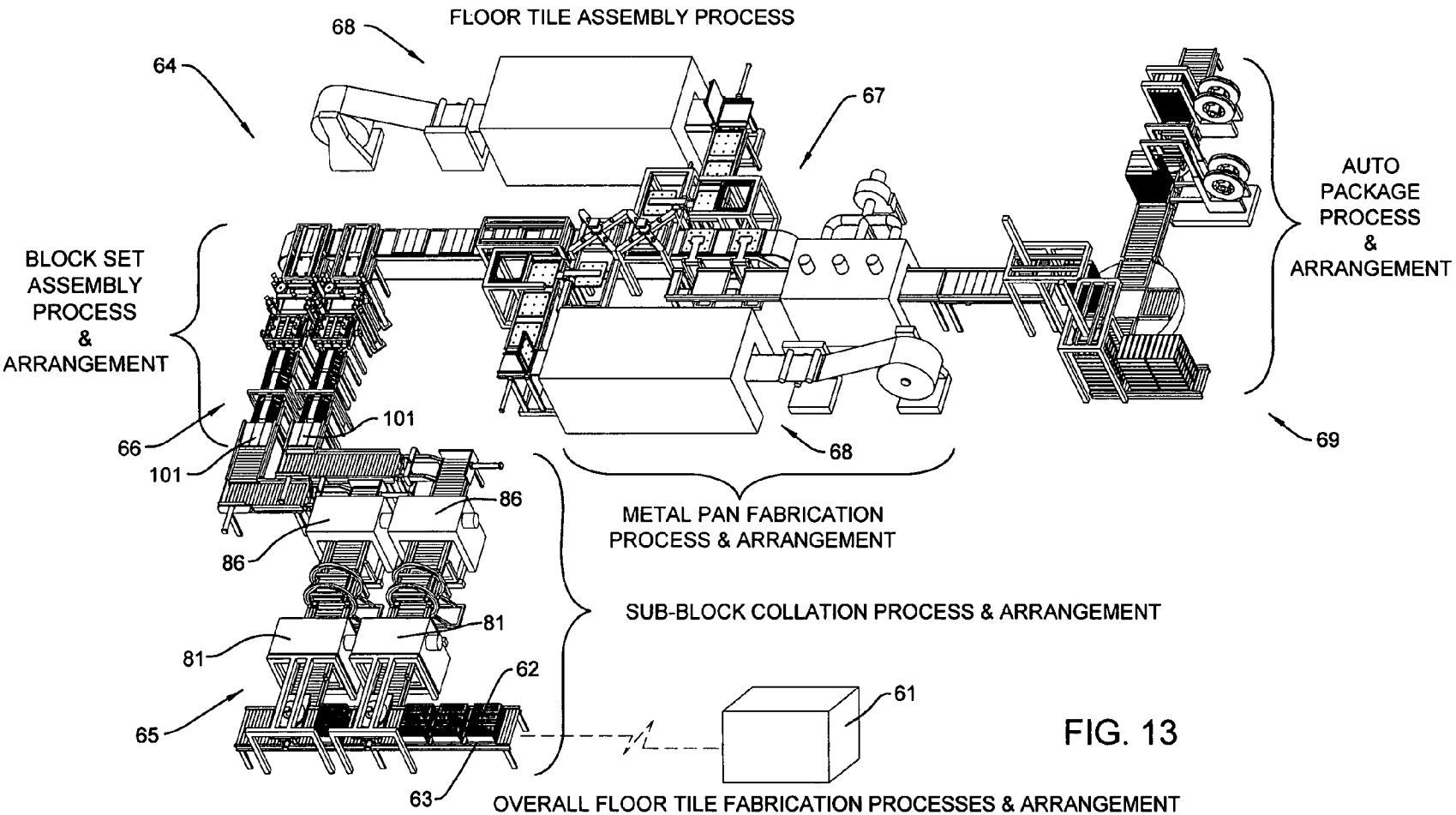
FIG. 13 is a perspective view which illustrates a fabricating arrangement and process for permitting rapid and efficient production of improved floor tiles according to the present invention.

Referring to FIG. 13, there is illustrated a generally automated manufacturing arrangement which permits efficient forming of large quantities of floor tiles having constructional features illustrated by FIGS. 2-11, and which carries out a process incorporating the basic process steps illustrated by FIG. 12.

In the manufacturing arrangement of FIG. 13, the preformed concrete sub-blocks 15 are formed in a forming press 61 (as described above), with the formed but uncured sub-blocks from this press being discharged in an adjacent upright relationship so that the spaced grouping 62 of sub-blocks are supported on a pallet 63, which pallet closes off the bottom of the press during forming of the sub-blocks therein. The sub-blocks are positioned on the pallet in sidewardly adjacent but spaced upright relationship, with the grouping containing a significant number of distinct preformed concrete sub-blocks corresponding to the number of mold cavities (for example, twenty-one) in the press 61. The grouping 62 of sub-blocks, as supported on the pallet 63, are appropriately cured by being passed through a curing kiln following their discharge from the press 61 and, after an appropriate curing time, the pallet and its grouping of sub-blocks are supplied to the tile fabricating arrangement 64 which, at the input end, receives individual preformed concrete sub-blocks 15, and at the output end discharges completed floor tiles 12.

The tile fabricating arrangement 64, at the input end thereof, includes a block collating arrangement 65 for grouping or collating the sub-blocks 15 so as to define a block grouping or set corresponding to the main block 13 for subsequent disposition and securement within the metal pan 14. The collated block grouping is supplied to an intermediate portion of the fabrication arrangement, namely a block set assembly arrangement 66 which effects adhesive securement of the sub-blocks 15 of the set to define the main one-piece block 13. This main one-piece block 13 is then supplied from the block set assembly arrangement 66 to a floor tile assembly arrangement 67 which also receives preformed metal pans 14 from a metal pan fabricating arrangement 68. The floor tile assembly arrangement 67 fixedly joins the pan 14 and main block 13 together to form the floor tile 12 which is then discharged for suitable packaging, handling and shipping, such as depicted by the exemplary packaging process 69.

In FIG. 13, the fabrication arrangement is illustrated as including two supply lines for the blocks 15, and two metal pan fabricating supply lines, all feeding into a floor tile assembly line which permits simultaneous forming of two floor tiles during each forming cycle, thereby providing improved quantity and speed of production. It will be appreciated, however, that the fabrication arrangement may consist of solely a single supply line throughout, with the floor tile assembly line forming solely a single floor tile during each forming cycle, and for convenience in explanation the following description relates to a single supply line for forming a single floor tile during each forming cycle.

Figure 14A:
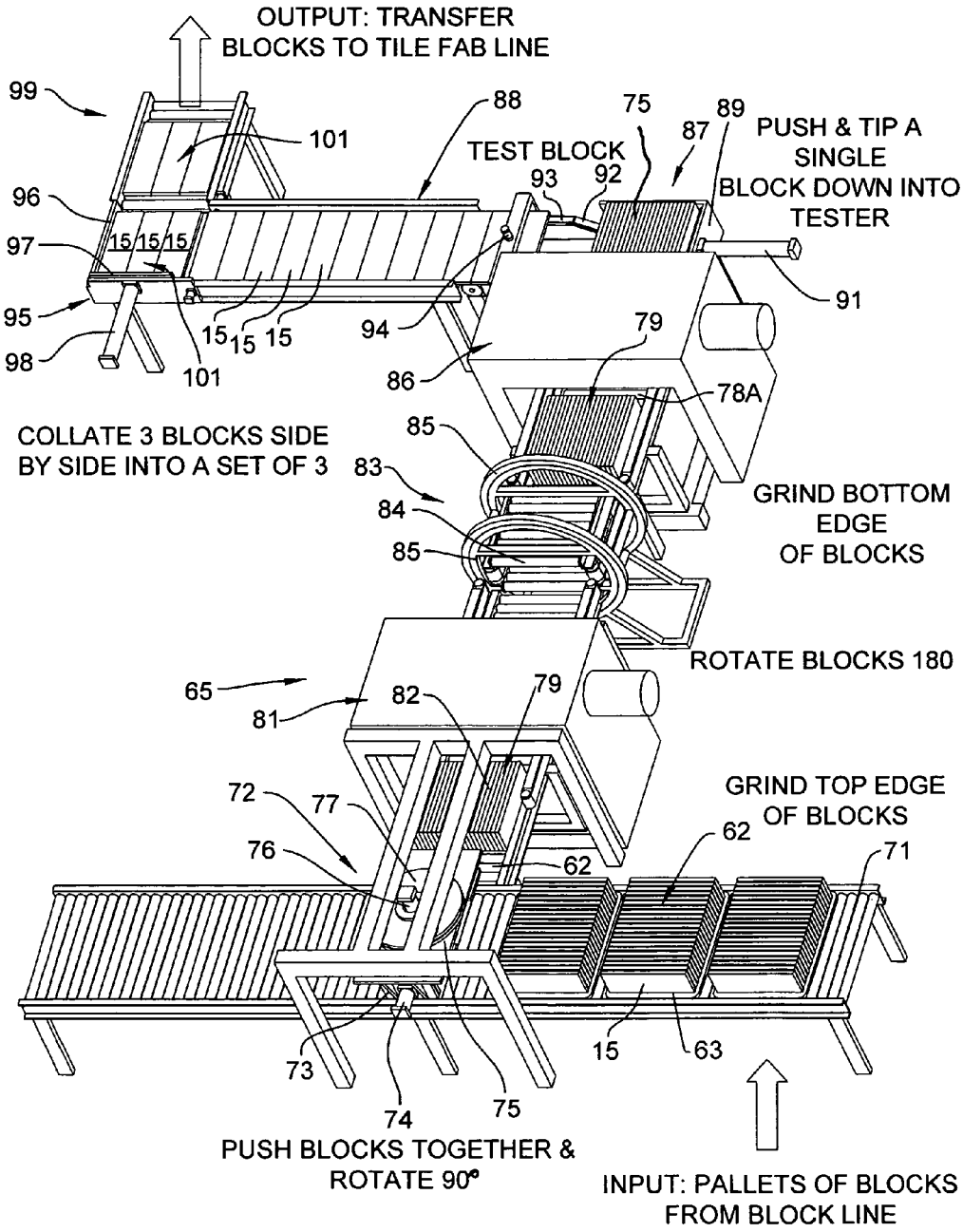
FIG. 14A, 14B and 14C illustrate portions of the arrangement illustrated in FIG. 13 on an enlarged scale.

Referring now to FIG. 14A, which is an enlarged illustration of the block collating arrangement 65, the palletized groupings 62 of spaced sub-blocks 15 are supplied to a conveyor 71 which advances the sub-block grouping 62 to a consolidating station 72. This consolidating station 72 includes a pair of opposed jaws 73 positioned in spaced relationship to engage outer faces of the outermost sub-blocks in the grouping 62. The jaws 73 are connected to pressure-type drive cylinders 74 which, when activated, move inwardly and push the sub-blocks 15 inwardly toward one another so that the sub-blocks move into direct abutting contact, thereby defining a closed horizontally-oriented stack or bundle. After closing the stack, the jaws 74 remain in gripping engagement with the ends of the stack and, due to the jaws being mounted on a rotatable top carrier 75 which is vertically displaceable by a drive cylinder 76, the drive cylinder 76 is energized (i.e. pressurized) to lift the jaws and the closed stack of sub-blocks upwardly away from the supporting pallet, the latter then being suitably discharged from the consolidating station.

With the closed sub-block stack in the raised or lifted position, the top carrier 75 is then rotatably displaced about its vertical axis through a 90 degree angle by a suitable drive motor (not shown), thereby causing the individual sub-blocks in the stack to be oriented transversely with respect to the conveyor 71. In addition, the rotatable top carrier 75 is mounted on a carriage 77 which is movable and driven by a drive device (not shown), such as a pressure cylinder, which displaces the carriage 77 transversely horizontally relative to conveyor 71 so as to position the stack of sub-blocks over the input end of a further conveyor 78 which extends transversely relative to the conveyor 71. The stack or closed grouping of sub-blocks 15, designated 79 in FIG. 14A, is then lowered onto the conveyor 78 due to lowering of the carrier 75 and release of the jaws 73. Then carrier 75 is raised, and the carriage 77 and jaws 73 are returned to their initial position as illustrated in FIG. 14A so as to receive the next palletized sub-block grouping 62.

As to the closed sub-block grouping 79 positioned on conveyor 78, the latter conveyor is energized and moves forwardly so as to move the stack 79 into and through a first edge grinding station 81. When moving through the station 81, top grinders (not shown) such as rotating grinding wheels or drum grinders engage and relatively move along the upper longitudinally-extending edge faces of the sub-blocks in the grouping 79 to effect surface finishing of these edge faces. This finishing removes irregularities and particularly burrs and edge flash, and provides a more defined dimensional tolerance as well as a smoother surface having desired surface flatness and squareness (i.e. perpendicular) relative to the main top and bottom block surfaces to facilitate subsequent adhesives joinder of the sub-blocks.

Following passage of the grouping 79 through the station 81, conveyor 78 remains energized so that the grouping 79 moves forwardly into a vertical rotating station 83. The conveyor 78 then stops so as to permit the next succeeding grouping of sub-blocks to be deposited on the input end thereof.

As to the sub-block grouping 79 which is moved into the rotating station 83, this latter station includes a carrier 84 which accommodates the grouping 79. This carrier 84 includes upper and lower conveyor sections which support the sub-block grouping on both the upper and lower edges thereof. The carrier 84 is movably (i.e. rotatably) supported on a pair of spaced support hoops 85 which enable the carrier 84, and the block grouping 79 supported thereon, to be vertically rotated 180 degrees, thereby positioning the block grouping 79 with the other unfinished longitudinally-extending edge faces 82 facing upwardly. After the sub-block grouping has been rotated (i.e. inverted), the conveyor sections of carrier 84 are energized to discharge the block grouping unto the input end of aligned conveyor 78A which is activated and advances the block grouping 79 into and through a second edge grinding station 86 which is substantially identical to the station 81 and includes grinders (such as rotating grinding wheels) which effect surface grinding of the upwardly-facing edge faces of the sub-blocks in the grouping 79 to remove roughness, flash and provide desired smoothness and squareness and dimensional tolerances as the grouping moves through the station.

After completion of the edge surface treatment (i.e. grinding) in the second grinding station 86, the block grouping 79 is then advanced by conveyor 78A out of the grinding station 86 into a block tipping station 87, the latter being defined at the input end of a further conveyor arrangement 88 which extends transversely relative to the conveyors 78 and 78A associated with the grinding stations.

At the block tipping station 87, a pusher plate 89 is provided which engages the side face of the endmost sub-block of the stack or grouping. The pusher plate 89 is coupled to a drive pressure cylinder 91 which pushes the stack or grouping 79 transversely, that is, along the direction of the conveyor 88. The cylinder 91 is activated to intermittently move the stack through a small distance corresponding to the thickness of each sub-block 15, which in turn causes the leading sub-block to be engaged by a tipping finger (not shown) which causes the leading block to tip vertically over onto upwardly inclined rail sections 92, at which point the tipped-over sub-block is engaged by the conveyor 88 and is slidably displaced upwardly along the inclined rails 92 onto parallel and horizontally extending main rails 93. The individual sub-blocks 15 lie in a flat condition and are moved along the rails 93 so as to create an abutting row of flat sub-blocks 15, as illustrated by FIG. 14A, with the ground lengthwise edge faces of adjacent sub-blocks being in abutting contact.

As the sub-blocks intermittently move along the rails 93, they are sequentially moved into a testing station which includes a block testing device 94, such as an impact hammer, which imposes an impact against the upward facing side face of the sub-block generally at the center thereof. If the sub-block contains defects such as cracks, due to improper forming within the mold, the sub-block will fracture and pieces thereof fall downwardly between the rails into a disposal bin. If the sub-block is free of such defects or cracks, then the sub-block, after impact at the testing station, continues to move forwardly along the rails 93 until reaching a block set collating station 95 as defined at the output end of the conveyor 88.

At the block set collating station 95, there is provided a guide plate 96 which functions as a front stop for engagement with the leading edge face of the leading sub-block 15, and there is additionally provided a pusher plate 97 which is positioned adjacent the end faces of the sub-blocks. The pusher plate 97 has a length which is sufficient to engage the end faces of three sidewardly abutting sub-blocks 15 substantially as illustrated by FIG. 14A. The pusher plate 97 is coupled to a drive pressure cylinder 98 which, when three sidewardly-contacting sub-blocks 15 are engaged with the guide 96 and pusher 97, is activated to move the pusher 97 horizontally transversely, thereby displacing the three sidewardly abutting sub-blocks 15 transversely so that this set of three sub-blocks, herein designated 101, is transversely moved into an input station 99 which includes a conveyor section for supporting the block set and which when energized forwards the collated block set 101 to the block set assembly arrangement 66.

Figure 14B:
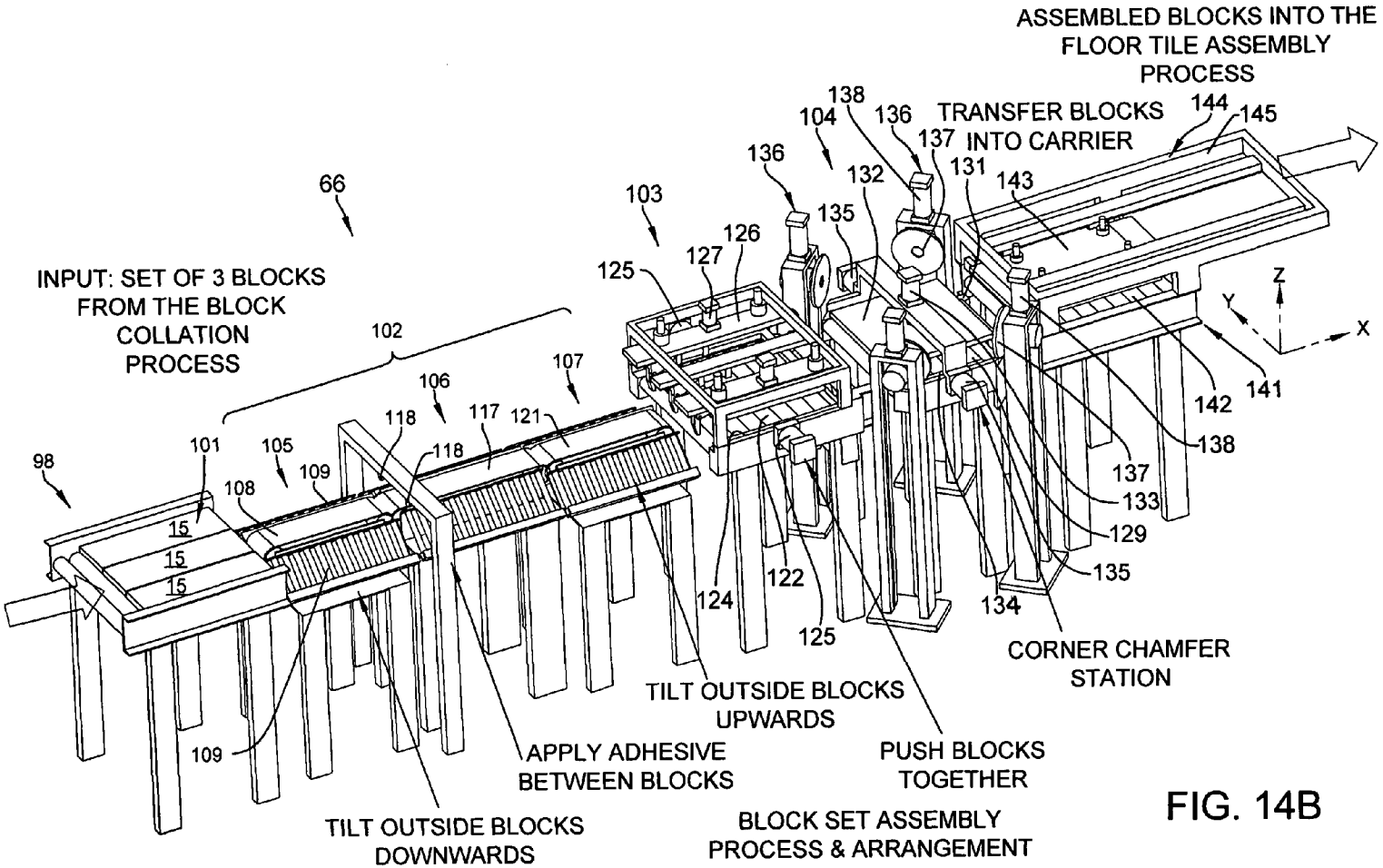

As shown in FIG. 14B, which is an enlargement of the block set assembly arrangement 66, the input station 99 containing therein the collated set 101 of sub-blocks 15 is aligned with an adhesive applying station 102 for applying adhesive to the abutting edge faces of the three sub-blocks defining the set. The collated set 101, after discharge from the adhesive applying station 102, is supplied to a block pressing station 103 which presses the collated sub-blocks together to effect rigid and fixed securement thereof to define the one-piece main block 13. This main block 13 is then passed from the pressing station 103 to a corner chamfer station 104 to chamfer the sharp corners of the main block.

Considering initially the adhesive applying arrangement 102, this includes three sequentially positioned stations, namely a first station 105 which effects downward angular tilting of the outermost sub-blocks relative to the center sub-block, whereby the three sub-blocks of the set 101 define a downwardly-oriented channel-like configuration. The set of sub-blocks are then moved into and through a second station 106 wherein a suitable adhesive is applied into the gaps defined between the opposed edge faces of the sidewardly adjacent sub-blocks, following which the set of sub-blocks, while still in the downwardly angled relationship, is moved to a third station 107 which is substantially identical to the first station 105 and which effects upward angular tilting or swinging of the outermost sub-blocks so as to bring them back into coplanar abutting contact with the centermost sub-block, whereby the adhesive-coated opposed edge faces are now in direct adhesive contact with one another.

Figure 15A:
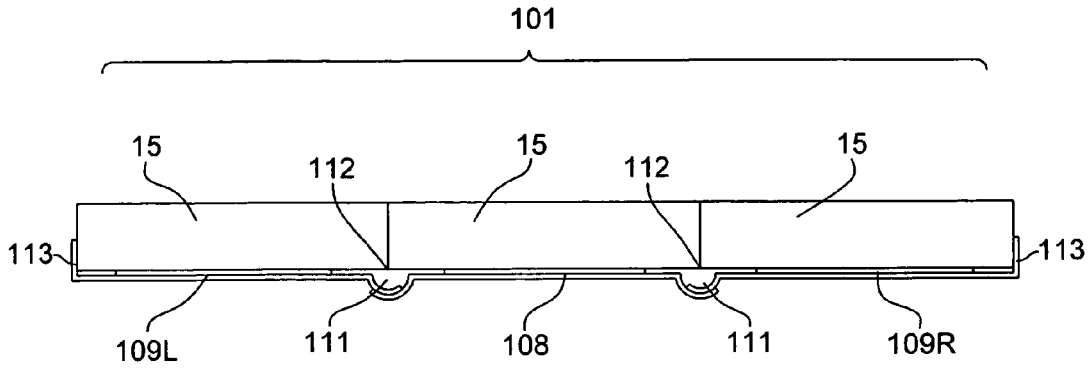
FIGS. 15A and 15B are fragmentary enlarged views which illustrate the conveying support arrangement for the collated block set when the latter is being assembled, consistent with the depiction of this structure in FIG. 14B.
Figure 15B:
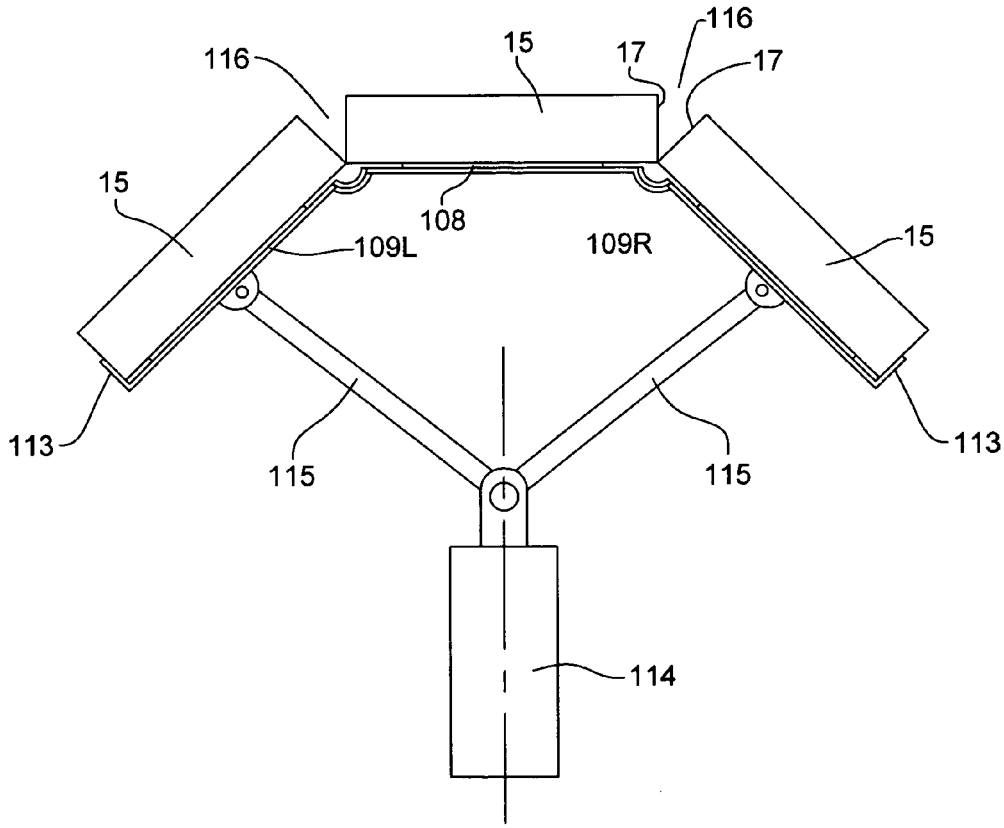

The first tilting station 105, as diagrammatically illustrated in FIGS. 15A and 15B, includes a center conveyor section 108 which supports thereon the center sub-block 15, and also includes a pair of separate side conveyor sections 109L and 109R disposed respectively on the left and right sides of the center conveyor section 108. Each of these side conveyor sections respectively supports thereon one of the outermost sub-blocks 15. When the collated set 101 of sub-blocks 15 move onto the station 105, the conveyor sections are all horizontally coplanar so as to support the collated set 101 in generally coplanar and sidewardly abutting relationship. The edgemost conveyor sections 109L and 109R, however, are supported by hinge arrangements 111 which effectively define longitudinally extending hinge axes 112, the latter being at or closely adjacent to the contact points between the lower longitudinally-extending edges of adjacent abutting sub-blocks 15. The outermost conveyor sections 109L and 109R are connected to a driving mechanism, such as by being pivotally connected to upper ends of links 115 which have lower ends pivotally connected to a driving pressure cylinder 114 so that the conveyor sections 109L and 109R can be swung downwardly about the hinges 111 so that the edge sub-blocks assume a downwardly inclined relationship relative to the centermost sub-block, such as at a downward angle of about 45 degrees from the coplanar relationship in the preferred embodiment. The conveyor frames are preferably provided with suitable edge guides 113 so as to maintain the outermost sub-blocks 15 in a disposition whereby the lower longitudinal edge of the outermost sub-block remains substantially in contact with the lower longitudinally extending edge of the adjacent center sub-block, the latter contact point substantially defining the axis 112 of the hinge 111.

When the outer sub-blocks 15 are in the downwardly inclined disposition illustrated by FIG. 15B, V-shaped gaps 116 are defined between the opposed edge faces 17 of each sidewardly-adjacent pair of sub-blocks 15.

With the collated set of sub-blocks in the downwardly inclined disposition illustrated by FIG. 15B, the collated set of sub-blocks at station 105 is moved forwardly by the conveyors onto a similar-shaped conveyor arrangement associated with the station 106. As the downward channel-shaped configuration of the sub-block set is moved onto and moved continuously through the station 106, a pair of adhesive applicators 118, which are positioned directly above and directed downwardly toward the gaps 116, are activated and apply adhesive lengthwise to one or both of the opposed edge faces 17 defining each of the gaps 116. After the adhesive has been applied throughout the length of the gaps, the three-section conveyor 117 associated with station 106 continues to move the collated set of sub-blocks forwardly onto a three-section conveyor arrangement associated with the station 107. This latter station is substantially identical to the station 105 and the outermost conveyor sections, after the sub-blocks have been moved thereon, are swung upwardly back into a position corresponding to that illustrated by FIG. 15A, whereby the collated set 101 of sub-blocks again resumes a generally coplanar relationship, with the opposed adhesive-coated edge faces 17 being brought into direct contact with one another.

The collated coplanar block set 101 at station 107 is then conveyed forwardly by the conveyor at station 107 onto a conveyor 122 which defines the support bed for the block pressing station 103. The collated block set 101 is moved forwardly so as to position itself against a vertically retractable front stop (not shown). The collated block set 101, when in engagement with the front stop, is disposed between a pair of side press plates 124 which are transversely movable inwardly by side pressure cylinders 125 which apply transverse (i.e. side) pressure to the coplanar collated block set. In addition, top pressure plates 126 driven by drive pressure cylinders 127 move downwardly into pressing engagement with the upper surface of the block set 101. The top pressure plates 126 are preferably elongated along the contact seam between each adjacent pair of abutting sub-blocks so that each pressure plate presses down on the adjacent pair of sub-blocks to ensure that the adjacent sub-blocks are vertically aligned at the seam or joint. The pressure cylinders 125 and 127 maintain pressure on the block set in the horizontal transverse and vertical (i.e. Y and Z) directions for a brief period of time so as to allow the adhesive joining the opposed side faces of the individual sub-blocks to rigidly setup, whereby the three sub-blocks hence create a rigid one-piece main block 13.

After the defined pressing time period, the top and side press plates 124 and 126 are retracted, as is the front stop, and the conveyor 123 conveys the one-piece main block 13 forwardly into the corner chamfer station 104 until the block contacts a retractable front positioning stop 131. A top pressure plate 132 is driven downwardly by a drive pressure cylinder 133 to effect downward (i.e. Z axis) clamping of the main block 13. In addition, side pressure plates 134 are driven transversely inwardly by drive pressure cylinders 135 to effect transverse pressing on opposite sides of the block (Y axis), similar to the side pressing action applied to the block at the block pressing station 103. This hence provides additional pressing action to permit continued curing of the adhesives between the contacting side faces of the sub-blocks. In addition, this maintains a rigid securement of the main block 13 and permits grinding devices 136 which cooperate with each corner of the main block to be activated. Each grinding device 136 in the illustrated arrangement includes a rotatable grinding wheel 137 which is rotatably carried on a carriage which is vertically slidably supported and is vertically moved downwardly on the frame by a drive pressure cylinder 138 so that the rotating grinding wheel contacts the sharp corner of the block 13 and effects removal of the corner as the wheel is moved vertically downwardly. In this manner, the four sharp corners of the main block 13 are removed and a small chamfer is created at each corner.

After completion of the corner grinding operation and disengagement of the transverse and vertical press plates, the conveyor bed 129 at station 104 is energized and discharges the main block 13 forwardly into a block transfer station 141 which effects transfer of the block 13 to the floor tile assembly arrangement 67.

The transfer station or arrangement 141 includes a conveyor 142 which assists in moving the main block 13 from the chamfer station 104 forwardly onto the transfer arrangement. When disposed on the conveyor 142, the main block 13 is stopped. A shuttle 143 positioned above the block has clamps which move downwardly and move into clamping engagement with the sides of the block, after which the clamps are moved upwardly to lift the block 13 from the conveyor 142. With the raised block 13 supported below the shuttle 143, the latter is horizontally advanced forwardly by a suitable drive unit such as a pressure cylinder (not shown) so that the shuttle 143 and the block carried thereon move onto the end part 145 of a guide frame 144. The frame end part 145 is positioned over an upper region 147 of a main advancing conveyor 146 (FIG. 14C) associated with the tile assembly arrangement 67. The shuttle 143, when positioned over an open guide carriage 148 which is carried on the conveyor 146, lowers the main block 13 downwardly and releases it into the carriage 148, at which time the shuttle clamps are retracted upwardly and the shuttle 143 is moved back to its position over the conveyor 142 so as to be in a position to engage the next main block positioned thereon.

The block advancing conveyor 146 has the block receiving carriages 148 carried thereon at predetermined intervals therealong. Each carriage has an opposed pair of side clamps which, after the block is positioned therein, are moved inwardly to properly position the block and create a gripping engagement with the edge thereof. For example, as the conveyor 146 advances the block away from the transfer position toward an adhesive station 151, followers on the clamps engage stationary guides or cams which cause the clamps to be moved into inward positions wherein they engage the edge faces of the block. These clamps are subsequently moved outwardly to release the block as the conveyor 146 moves the block into a tile assembly station 152 (as described hereinafter), which release of the clamps occurs reversely to the closing function described above.

Figure 14C:
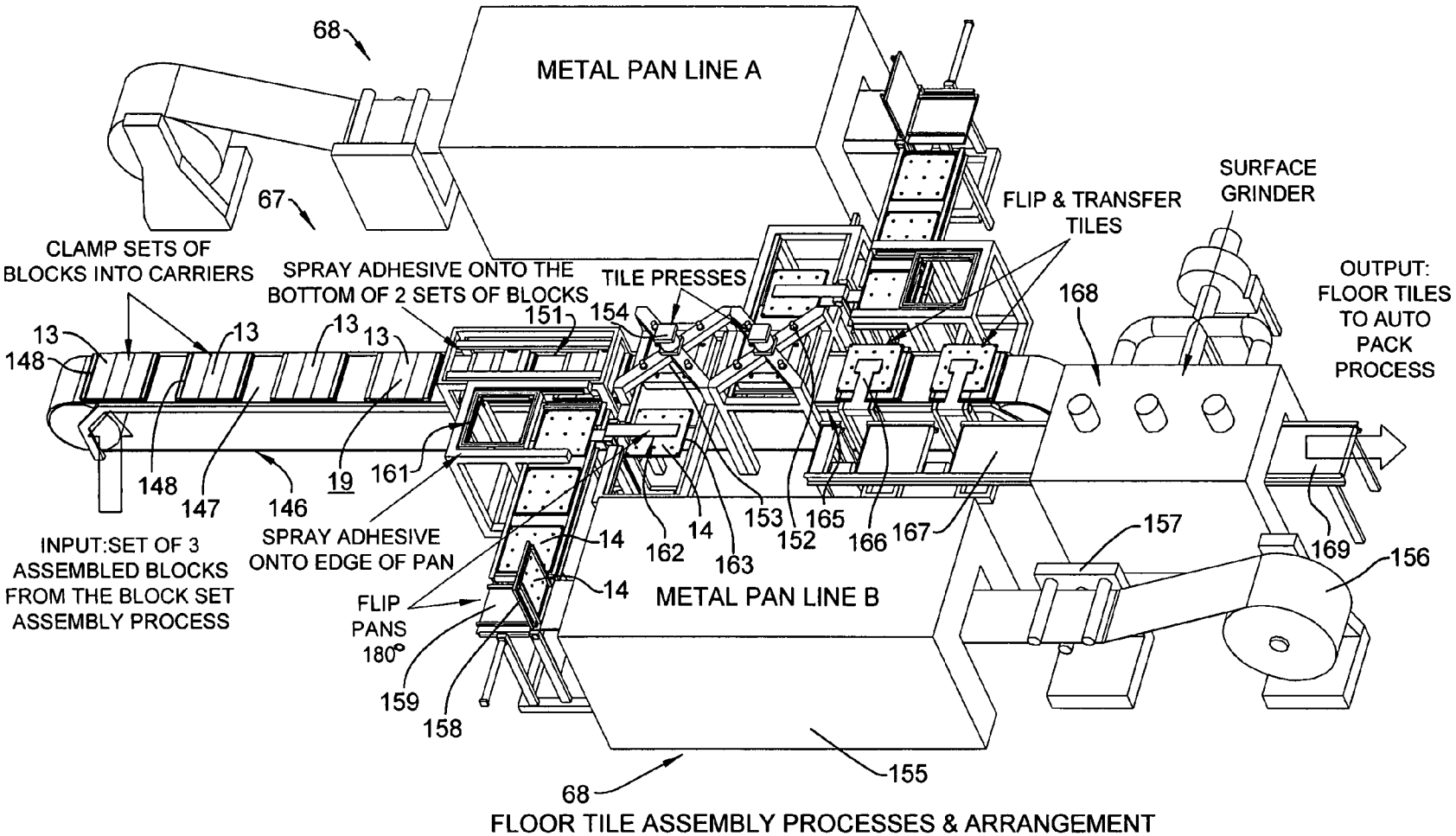

While the tile assembly arrangement 146 illustrated in FIG. 14C permits the forming of two floor tiles during each forming cycle to provide increased productivity, such arrangement operates in the same manner as described above relative to the forming of a single floor tile so that further distinguishing description is believed unnecessary.

The block advancing conveyor 146 of the tile assembly arrangement 67, as illustrated by FIG. 14C, initially sequentially and intermittently feeds the main blocks 13, as held by the respective carriages 148, into adhesive applying station 151. When the main block is stationarily positioned at this station, an adhesive applying device (not shown), such as a spray nozzle positioned above the conveyor, applies adhesive over substantially the entirety of the upwardly-facing surface of the main block 13. This adhesively-coated surface ultimately becomes the bottom surface of the block when the latter is adhesively adhered into the metal pan.

Upon completion of the adhesive coating of the upwardly-facing surface of the block 13 at station 151, the conveyor 146 then moves the block forwardly into the tile assembly station 152, which for convenience is referred to herein as the tile press, and stops. As briefly discussed above, the clamps associated with the carriage 148 are released from the block as the latter moves into the tile press.

The press 152 includes a top press plate 153 which is vertically moved downwardly by a drive pressure cylinder 154 for effecting pressing together of a metal pan 14 and a main concrete block 13 as described hereinafter.

The tile press 152 is also supplied with a metal pan 14, the latter being formed and supplied from the separate metal pan fabricating arrangement 68. This latter arrangement, as illustrated in FIG. 14C, includes a pan forming apparatus 155 which is supplied with metal sheet from a roll 156, with the sheet being fed through a straightener 157 as it is fed into the forming apparatus 155. This forming apparatus 155 may comprise a conventional multiple-stage forming press which includes appropriate punching and cutting tools so that the sheet 156, when fed into the apparatus 155, is cut to create a metal sheet of desired size, which sheet is subjected to suitable punching or cutting at the corners to create slot-like slits. Thereafter a multiple-stage pressing operation is performed on the sheet to cause transverse forming of the side walls relative to the bottom wall of the pan, with the outer or top edges of the side walls additionally being formed or reshaped to create the hems. The pan 14 can in its entirety be formed within the fabricating apparatus 155, with the pan 14 being in a completed state possessing the structural configuration and features described above relative to FIGS. 2-11.

In the illustrated arrangement, the pan 14 when formed within the arrangement 155 is oriented so as to open downwardly, whereupon the pan 14 upon exiting the forming apparatus 155 is engaged by a vertical flipping device 158 which vertically rotates the pan 180 degrees so as to deposit the pan 14 in an upwardly-oriented position on a transfer conveyor 159. This transfer conveyor 159 then sequentially and intermittently move the upwardly-opening pans 14, disposed in a sequential row, into an adhesive applicator station 161. In this adhesive applicator station 161, suitable adhesive applicators such as spray nozzles are positioned in close proximity to the inner side surfaces of the pan side walls so as to apply adhesive to substantially the entire inner surfaces of all pan side walls. Upon completion of the adhesive application, then the pan 14 is engaged by a flipping arm 162 which rotates the pan vertically upwardly out of the adhesive applicator 161 and rotates it through an arc of 180 degrees so as to deposit the pan, in a downwardly facing orientation, onto a transfer shuttle 163. The shuttle 163 then moves the downwardly facing pan, after its disengagement from the flipping arm 162, horizontally into the tile press 152 wherein the downwardly-facing pan is positioned vertically between the main block 13 and the top press plate 153, with the pan being generally vertically aligned directly above the main block 13. The pan 14 is then clamped by suitable gripping fingers (not shown) associated with the tile press, which fingers will typically grip the side wall hems, and the transfer shuttle 163 is returned back to its original position for engagement with the next incoming pan.

Once the main block 13 and the pan 14 have been positioned and engaged within the main tile press 152, then the gripping fingers which engage the hems of the pan side walls are moved slightly outwardly to cause a slight outward resilient deflection of all of the pan side walls, following which the fingers move the pan downwardly to telescope the pan over the main block, causing the adhesive-coated upwardly-facing surface of the main block 13 to engage the bottom wall of the pan 14. The main press plate 158 is then moved downwardly and engaged with the bottom of the pan to exert downward pressure so that the block 13 and pan 14 become intimately and rigidly secured together due to setting up of the adhesive between the contacting bottom walls of the block and pan.

Once the press plate 158 has properly engaged and applied pressure to the pan and block, the gripping fingers holding the side wall hems are released. This allows the pan side walls to resiliently spring inwardly back toward their initial position, which causes the adhesive coated side walls to contact the side faces of the block. In addition, pressing members or jaws (not shown) as provided on the press are moved inwardly and engage the hems associated with the pan side walls so as to press the hems slightly inwardly, thereby not only increasing the contact pressure between the pan side walls and the side faces of the block so as to increase the adhesive securement at the areas of contact, but also allowing slight deformation of the hems so as to create the desired dimensional width across both transverse dimensions of the finished floor tile 12.

The hem pressing jaws and the top pressure plate are then released, and the fully assembled floor tile 12 is discharged by a conveyor 146 from the tile press 152 into a transfer position located downstream of the tile press, at which position the assembled floor tile 12 is engaged by a further flipping device 166 which transfers the floor tile by rotating it vertically 180 degrees and then depositing it on a transfer surface 167. When deposited on the surface 167, the assembled floor tile is oriented so that its upper concrete surface, as defined on the exposed surface of the concrete block, faces upwardly. The transfer surface 167 then advances the assembled floor tile into a surface treating station 168, such as a grinding station, which effects grinding and polishing of the exposed upper surface of the concrete block so as to provide a desired appearance, such as a polished marble-like look, and to also provide desired dimensional height-control of the finished floor tile.

The surface treating station 168 typically includes a rotatable wheel grinder positioned to grind the upper surface of the concrete block to provide a desired upper surface on the assembled floor tile. This grinder is also effective for removing any excess adhesive which may have squeezed out of the joint or interface between adjacent sub-blocks, particularly if the adhesive is epoxy (as explained hereinafter), since the longer curing time of epoxy ensures that the epoxy is not yet fully cured at the time the assembled floor tile is sent to the surface treating station 168.

Upon completion of the grinding operation within the surface treatment station 168, the finished floor tile is moved to a discharge location 169, whereat the tile is discharged and handled as desired so as to permit suitable packaging and transporting.

It will be appreciated that in situations where the floor tiles are to be used under a carpet, particularly a foam-backed carpet, then in such case the finishing (i.e. grinding) of the top face of the tile at station 168 may not be required since the top face is not exposed and the foam-backed carpet may be able to adequately compensate for slight surface and/or dimensional variations.

As diagrammatically illustrated in FIG. 13, the completed and discharged floor tiles can be suitably vertically stacked, with a selected number within the stack being supported on a pallet, and the palletized stack of floor tiles being suitably banded so as to facilitate their handling and transport.

Figure 16A:
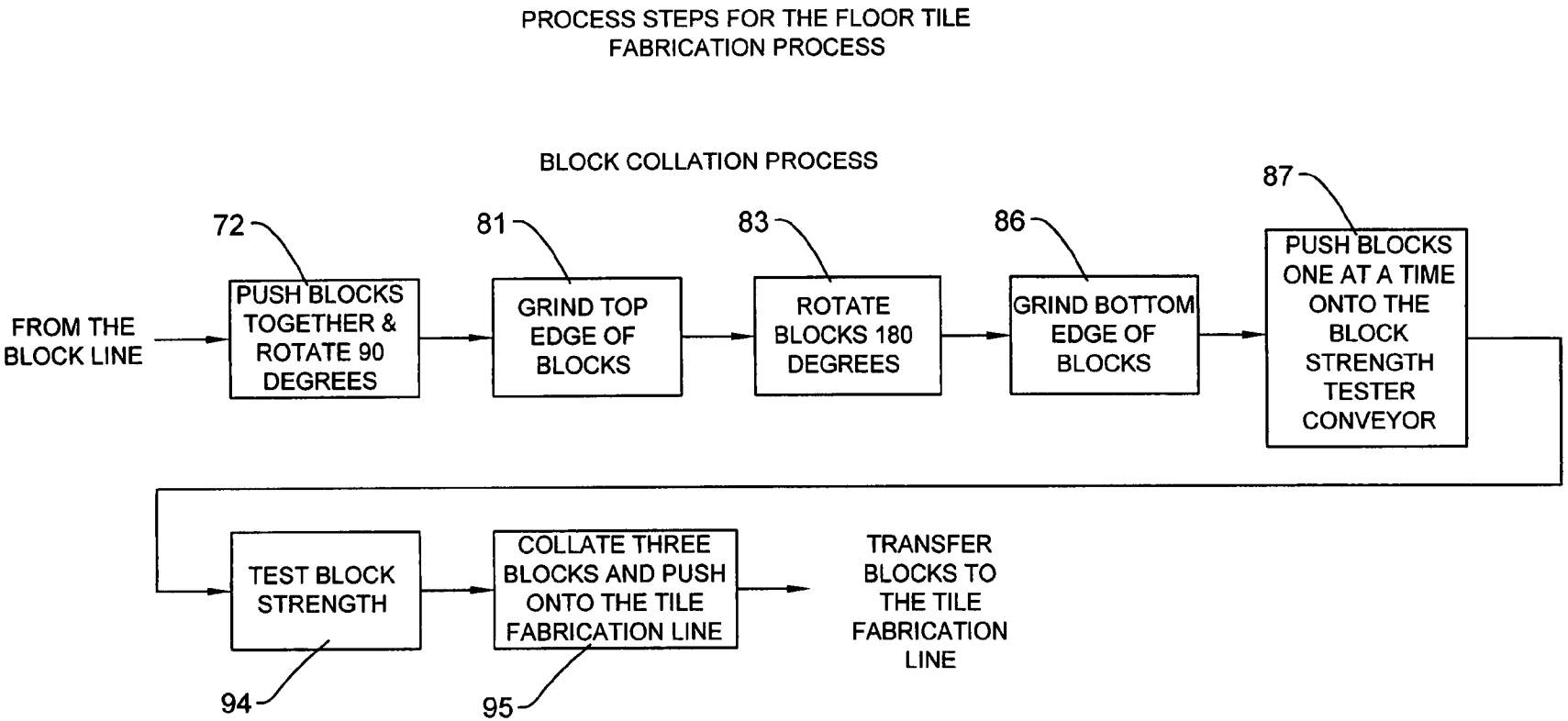
FIGS. 16A, 16B and 16C represent, in block form, a flowchart for the basic process steps carried out by the arrangement depicted by FIGS. 14A, 14B and 14C, respectively.
Figure 16B:
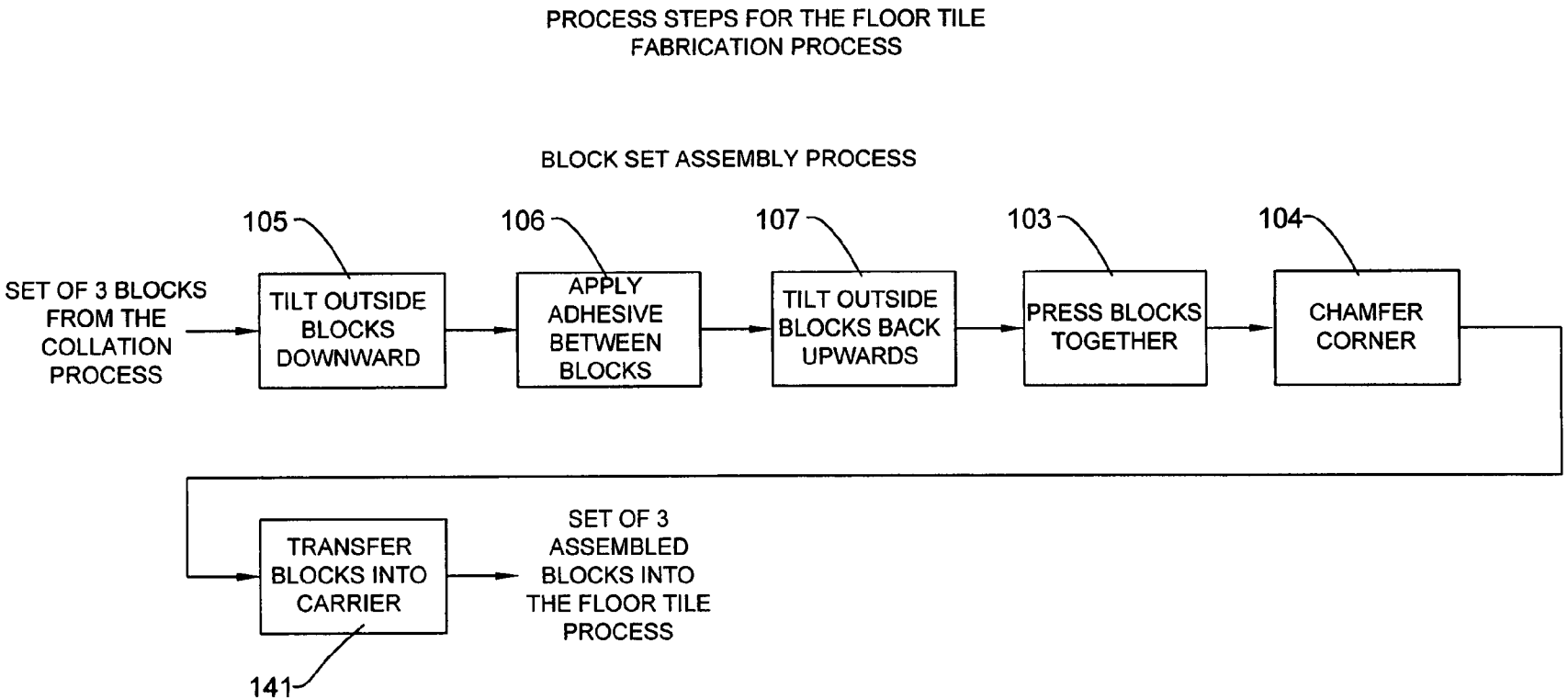
Figure 16C:
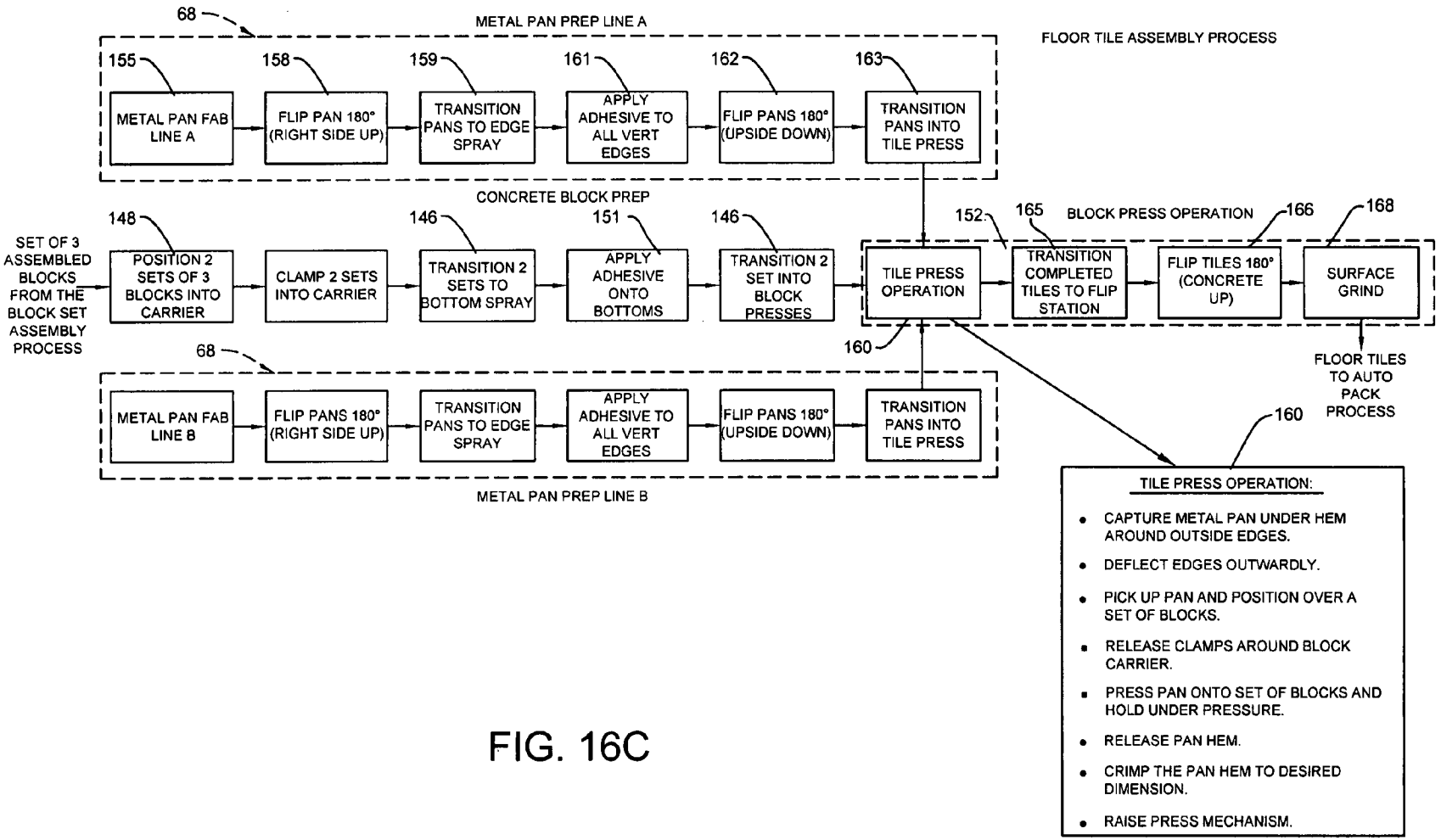

Referencing now FIGS. 16A, 16B and 16C, there is illustrated a block diagram flowchart which effectively depicts therein the basic process steps which are carried out with respect to forming the floor tile by means of the process and arrangement depicted by FIG. 13. The specific steps which are set forth in FIGS. 16A, 16B and 16C correspond to the process steps carried out by the arrangements illustrated respectively in FIGS. 14A, 14B and 14C, and hence the steps in FIGS. 16A, 16B and 16C are designated by the same reference numerals which are utilized in respective FIGS. 14A, 14B and 14C.

With the arrangement of the present invention, additional variations and modifications, some of which are believed highly desirable with respect to providing improved strength and rigidity to the overall floor tile, are discussed below.

First, while the floor tile 12 has been described above as having adhesive applied to the inner side surfaces of the pan 14 and the bottom face of the block 13, it will be appreciated that the adhesive can also be applied to the inner bottom wall of the pan so that, with adhesive layers on both the pan bottom wall and the block bottom face, a more intimate coating of both the block and bottom wall will occur and a more complete filling of all voids and irregularities will occur, thereby providing an improved fixed bonding of the block to the pan. Applying adhesive to the inner upper surface of the pan bottom wall can be carried out at the adhesive applying station 161 and can be carried out substantially simultaneous with the application of adhesive to the inner side surfaces of the pan side walls.

While all of the surfaces coated with adhesive may be coated with the same adhesives, in which case the adhesive is preferably a hot melt (as discussed above), it is believed desirable to utilize adhesives which provide different strength characteristics with respect to time. For example, while the bottom of the block (and also the bottom of the pan if adhesively coated) are preferably coated with a hot melt adhesive since such hot melt sets up quickly due to the large heat sink defined by the block which provides a rapid fixation of the block to the pan to facilitate subsequent manufacturing and handling, it will be appreciated that a different type of adhesive can be applied to the inner surfaces of the pan side walls. For example, the adhesive applied to the pan side walls may be a time-setting adhesive, such as an epoxy adhesive which can be applied to the inner surfaces of the side walls, such as by applying a bead of adhesive along the side walls. Such adhesive takes a longer time to cure and set, but since the pan side walls do not initially define the main fixation of the block to the pan, this longer set time is acceptable. Also, the epoxy adhesive is believed to provide better holding or fixing capability.

Figure 17:
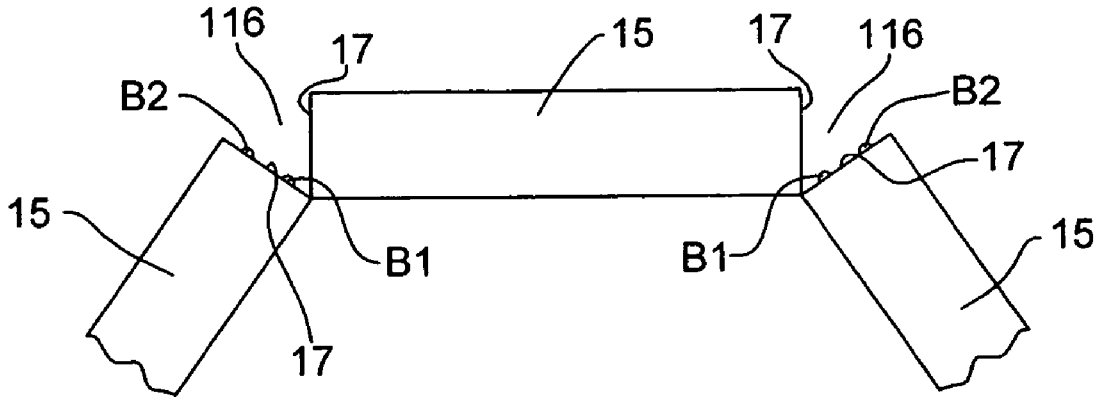
FIG. 17 is a diagrammatic illustration similar to FIG. 15B but showing a preferred variation for effecting adhesive securement being adjacent sub-blocks.

With respect to the adhesive used to join the opposed edge faces 17 when forming the main block, two different types of adhesive may be used. In what is believed to be a preferred construction, as illustrated in FIG. 17, a bead B1 of a first adhesive, such as a time-setting epoxy, is applied lengthwise along at least one of the opposed edge faces 17 adjacent the bottom of each gap 116. In addition, a second adhesive, such as a bead B2 of hot melt, is applied lengthwise along at least one of the opposed edge faces 17 in closer proximity to the open mouth of the gap 116 so that the hot melt bead does not directly overlap the epoxy bead. When the sub-blocks 15 are closed and pressed together, the hot melt B2 creates a rapid fixation of the sub-blocks in sidewardly abutting and adjacent relationship (so as to facilitate subsequent assembly of the floor tile), while the slower-setting epoxy B1 provides increased gripping and fixing strength between the sidewardly adjacent sub-blocks after the epoxy fully cures.

The use of two different adhesives, specifically hot melt and epoxy, for joining the opposed edge faces of the sub-blocks together as described above and as illustrated by FIG.

17, provides other structural and operational advantages over and above the additional fixation strength achieved by the additional use of an epoxy adhesive. More specifically, by positioning the epoxy adhesive (the bead B1 in FIG. 17) in closer proximity to the apex of the gap 116, the epoxy is hence close to the exposed upper surface of the main block when the latter is secured into the metal pan since the block is vertically inverted relative to FIG. 17 when secured within the pan. This disposition of the cured and set epoxy along the seam or abutting joint effectively at the upper surface of the block is desirable since the epoxy has a generally gray color which effectively blends into the gray color of the concrete block, whereby the seam created at the abutting joint has little if any visibility. Furthermore, the presence of the strong epoxy in the seam or joint between the adjacent sub-blocks, particularly in the vicinity of the exposed upper surface of the finished block, provides significant strength and reinforcement along the lengthwise extending edges of the adjacent sub-blocks so as to prevent or minimize any cracking or fracturing along these edges.

While the epoxy adhesive can be applied as a bead, as illustrated by the bead B1 in FIG. 17, it will be appreciated that the epoxy can also be sprayed so as to define a band which extends lengthwise along one or both of the opposed edge faces in close proximity to the apex of the gap. As to the hot melt adhesive, however, same is preferably applied in the form of a bead, such as indicated at B2 in FIG. 17, since this effectively results in adhesive being in a more concentrated mass so as to prevent cooling of the hot melt too quickly, prior to the sub-blocks being adequately pressed together.

The arrangement illustrated by FIGS. 15A and 15B, namely the creation of the V-shaped gaps 116 for application of the adhesive to the edge faces of the sub-blocks, is highly desirable with respect to providing a supporting structure which maintains the lower edges of adjacent sub-blocks substantially in abutting contact, thereby closing off the apex of the V-shaped gaps 116. In this manner, the adhesive which is applied to the edge faces 17 is confined and controlled and, when the edge sub-blocks are pivoted upwardly into coplanar relationship, the adhesive on the opposed edge faces 17 is squeezed upwardly toward the upwardly-facing surface of the main block, which surface is ultimately adhesively coated and functions as a bottom surface for securement to the pan. In this manner the squeezing out of adhesive at the apex of the gap 116, which apex is effectively at the exposed upper surface of the finished block when the latter is assembled in the pan, is eliminated or at least greatly minimized.

With respect to the preferred adhesives utilized in accordance with the present invention both for securing the sub-blocks together, and for securing the main block to the metal pan, it will be recognized that the choice between using either hot melt or epoxy, or the choice of using a combination of hot melt and epoxy for joining the sub-blocks together or for joining the main block to the metal pan, is actually a choice as to which adhesive or adhesives provide a setting time which is most suitable and optimum relative to the speed of the manufacturing process. This, in addition, must be balanced relative to the different cost factors associated with using hot melt versus other adhesive. For example, for maximizing the speed and hence the rate of production, it is believed that hot melt is the more optimum adhesive since the hot melt cures or sets up very quickly, typically in a time of between ten and fifteen seconds, so that this enables the manufacturing process to occur at a very rapid rate. Conversely, while epoxy ultimately results in a greater bonding strength, nevertheless the cross-linking epoxy typically requires in the neighborhood of about two minutes to fully cure and set-up. For this reason, this may result in a possible slowdown in the production rate in an automated system, although this can be partially compensated for by including an accumulation station into the overall production line, such as between the tile press and the final top grinding station, so as to allow proper bonding of the main block to the pan prior to carrying out the top surface grinding operation. As to the adhesive used to fixedly join the sub-blocks together to define the main block, a combination of hot melt and adhesive is believed to be preferred for this joint since the hot melt provides rapid fixing together of the blocks so as to permit subsequent manufacturing and handling steps to be carried out, whereas the slower setting epoxy ultimately provides a greater bonding strength between the blocks so as to withstand the greater external loads imposed on the upper surfaces of the blocks when the floor tiles are in an installed environment.

In the manufacturing process for a floor tile as disclosed herein, and specifically the process which is carried out utilizing the arrangement illustrated by FIGS. 13-17 as described above, the manufacturing process starting at the block set collating station 95 involves a series of manufacturing manipulations which are carried out sequentially at a series of closely adjacent working stations, which stations typically involve a brief stoppage of the main block at the station to permit the specified manufacturing process steps to be carried out, with the main block both prior to and after joinder to the pan being sequentially and rapidly moved or indexed from station to station by the appropriate conveyors provided for that purpose, as discussed above. In this manner, and in accordance with a preferred and anticipated operation of the inventive system, it is anticipated that each cycle in the overall manufacturing process, which cycle is defined as the time required to carry out the necessary manipulations at a specified work station combined with the time required to advance the work piece (i.e. the main block) to the next station, will be a very short time interval, such as a time interval of approximately six seconds, for example. This hence enables a single-line floor tile manufacturing apparatus to produce completed floor tiles at the rate of about ten tiles per minute (twenty tiles per minute for the double system illustrated by FIG. 14), thereby ensuring an extremely high rate of production of floor tiles. With production of floor tiles at this rate, the setting or curing time of the adhesives utilized both for securing the sub-blocks together, and for securing the main blocks to the metal pan, are critical so as to permit proper handling of the product during manufacture while at the same time permitting production at this rapid rate.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. A process for forming a floor tile for a raised floor system, comprising the steps of:

providing a mold defining therein a plurality of mold cavities disposed in sidewardly spaced but adjacent relationship with the individual cavities being disposed in upright relation relative to the mold;

molding a plurality of generally rectangular concrete blocks within the mold cavities;

removing the molded blocks from the mold while maintaining the blocks in a grouping wherein the blocks are in the same spatial relationship defined by the mold cavities, and allowing the blocks to cure;

compressing the grouping of blocks sidewardly into a bundle wherein the blocks are in sideward abutting contact with one another;

feeding the bundle of blocks past a grinder to effect surface finishing of the lengthwise-extending edge faces of the blocks as defined on one side of the bundle;

feeding the bundle of blocks past a grinder to effect surface finishing of the lengthwise-extending edge faces of the blocks as defined on the other side of the bundle;

then separating the individual blocks from the bundle and vertically rotating the individual blocks from an upright position into a generally flat horizontal position;

then sequentially feeding the blocks into a collating station and, at said collating station, moving a predetermined number of blocks into sidewardly abutting contact to define a block set which has a generally rectangular profile in plan view;

advancing the block set from the collating station to an adhesive station and applying adhesive to one or both of the opposed edge faces as defined between adjacent blocks;

pressing the blocks together to permit the adhesive to set-up and fixedly join the blocks of the set together to define a single one-piece rigid main block;

providing a box-shaped support pan having a shallow upwardly-opening compartment defined by a bottom wall of the pan and upright side walls which join to edges of the bottom wall and protrude upwardly therefrom;

applying adhesive to one of (1) the bottom surface of said preformed main concrete block and (2) the inside surface of the pan bottom wall;

positioning the preformed main concrete block into said compartment of said pan so that the bottom surface of said main concrete block contacts the pan bottom wall; and pressing the block and pan together to allow the adhesive at contact areas between the pan bottom wall and the bottom surface of the main concrete block to cure so as to effect fixed securement of the block to and within the pan.

2. A process according to claim 1, including the steps of:

positioning said bundle of blocks so that said one side thereof faces upwardly for permitting grinding of the edge faces thereof;

then vertically rotating the bundle through 180 degrees so that the other side of the bundle faces upwardly; and thereafter effecting surface finishing of the elongate edge faces of the blocks defining the other side of said bundle.

3. A process according to claim 1, including the steps of:

vertically swingably moving one block of said set relative to an adjacent block to create a V-shaped gap which extends lengthwise between the opposed edge faces of the adjacent blocks;

then applying said adhesive lengthwise along one of the opposed edge faces defining the V-shaped gap; and then relatively vertically swinging the blocks back into a coplanar abutting position, followed by pressing of the blocks together to allow the adhesive to set up and fixedly join the blocks together.

4. A process according to claim 3, wherein the step of applying adhesive lengthwise along the gap includes the step of applying a first lengthwise-extending bead of a first adhesive to one of the opposed surfaces, and applying a second lengthwise-extending bead of a second adhesive to one of the opposed surfaces, the first and second beads being of different adhesives and being spaced apart in the widthwise direction of the surfaces so as to prevent any significant commingling of the adhesives, the first adhesive having a shorter setting time, the second adhesive having a higher bonding strength.

5. A process according to claim 1, including the step of supplying only three identical blocks to said collating station to define said set, with two of said blocks being disposed in abutting contact with opposite sides of the third block so as to define a main block having a generally square plan-view profile.

6. A process according to claim 5, including the steps of:

vertically swinging the two outermost blocks relative to the centermost block so that the three blocks in cross-section define a generally channel-shaped configuration with a generally V-shaped gap being defined adjacent opposite lengthwise extending edge faces of the adjacent block;

applying a band or bead of said adhesive lengthwise along one of the opposed edge faces defining each gap;

then vertically swinging the outermost blocks back into a position wherein all of the blocks are generally coplanar so as to close the gaps; and effecting the pressing of the blocks together so that the adhesive sets up and fixedly joins the three blocks together to define said main block.

7. A process according to claim 5, wherein a first adhesive bead of epoxy is applied to one of the opposed edge faces in the vicinity of the apex of each said gap;

wherein a second bead of a hot melt adhesive is applied to one of the opposed edge faces of each said gap with said second bead being spaced sidewardly from the first bead so as to be disposed more closely adjacent the mouth of the gap;

wherein the hot melt sets up more quickly to effect initial fixed securement between the blocks when the blocks are pressed together to define the main block.

8. A process according to claim 7, wherein the adhesive as applied to the bottom surface of the main block comprises a hot melt, and wherein the bottom surface of the block corresponds to the surface which is positioned adjacent the mouth of the gaps during the process steps wherein the adhesive is applied to the edge faces of the blocks.

9. A process for forming a floor tile for a raised floor system, comprising the steps of:

providing a plurality of molded concrete sub-blocks;

supplying said sub-blocks to a collating station;

organizing a predetermined number of said sub-blocks, at said collating station, into a block set wherein the predetermined number of sub-blocks are disposed in sideward abutting contact and define an overall geometric arrangement having a generally rectangular plan-view profile corresponding to a desired main block;

movably displacing the collated block set from the collating station to a displacement station whereat the sidewardly-contacting pairs of blocks are slightly sidewardly displaced to create gaps between the opposed pairs of abutting edge faces;

applying adhesive into each of the gaps and onto at least one of the edge faces of each opposed pair;

relatively displacing the blocks back into their original position wherein all of the opposed edge faces of adjacent blocks are again disposed in flush contacting engagement, and pressing the blocks sidewardly together to permit the adhesive between the edge faces of the blocks to set up and fixedly join the sub-blocks together to define a one-piece main block;

forwarding the main block to an adhesive station, and applying an adhesive over substantially the entirety of only one of the exposed top and bottom surfaces of the main block;

providing a box-shaped metal support pan having a shallow upwardly-opening compartment defined by a bottom wall of the pan and upright side walls which join to and protrude upwardly from edges of the bottom wall;

positioning the block and pan in generally opposed relationship, and then relatively moving the block into the compartment of the pan to cause the adhesive-coated main surface on the block to contact the bottom wall of the pan; and pressing the pan and block together while allowing the adhesive to set up and effect fixed securement of the block to the bottom wall of the pan.

10. A process according to claim 9, wherein a maximum of three substantially identical sub-blocks of rectangular configuration are collated to define the set at the collation station.

11. A process according to claim 9, wherein the collated set of sub-blocks contains only three sub-blocks which are all substantially identical and of rectangular configuration, and wherein the three sub-blocks are disposed in sideward abutting contact with one of the sub-blocks being positioned centrally between the other two sub-blocks so as to define a plan-view profile having a generally square configuration.

12. A process according to claim 11, wherein the three sub-blocks defining the set when moved to the displacement station are vertically displaced so that the two outermost sub-blocks are vertically inclined relative to the centermost sub-block whereby the grouping of sub-blocks in cross-section define a generally channel-shaped configuration, and wherein a gap is defined adjacent each lengthwise-extending edge of the centermost block, which gap defines a separation between the opposed edge faces defined on one side of the centermost block and an opposed adjacent side of one of the edgemost blocks, and the adhesive being applied to the respective edge face associated with the gap when the three blocks of the set are in said channel-shaped cross-sectional configuration.

13. A process according to claim 12, wherein the adhesive applied to the gaps between sub-blocks comprises first and second beads defined respectively by first and second adhesives which are different from one another and provide different setting times and bonding strengths, the first and second beads being sidewardly displaced as they are applied to the respective edge surfaces.

14. A process for forming a floor tile for a raised floor system, comprising the steps of:

providing a box-shaped support pan having a shallow upwardly-opening compartment defined by a bottom wall of the pan and upright side walls which join to edges of the bottom wall and protrude upwardly therefrom;

providing a plurality of one-piece concrete sub-blocks having a thickness which equals or slightly exceeds the depth of the shallow compartment;

positioning a predetermined number of preformed concrete sub-blocks in horizontally adjacent side by side relationship so that the sub-blocks, when opposed edge faces of the sub-blocks are sidewardly engaged with one another, define a plan-view profile which substantially corresponds to a plan-view profile of the compartment;

applying a first band of a first adhesive to at least one edge face of each opposed pair of edge faces as defined on said sidewardly adjacent sub-blocks;

substantially simultaneously with the above, applying a second band of a second adhesive to at least one edge face of each opposed pair of edge faces as defined on said sidewardly adjacent sub-blocks, said first and second bands as initially applied being sidewardly spaced from one another, and said first and second adhesives being different with said first adhesive having a shorter setting time and said second adhesive having a higher bonding strength;

pressing said sub-blocks sidewardly together to permit setting up of at least said first adhesive to effect fixed securement of said sub-blocks at said opposed contacting side faces so as to define a preformed one-piece main concrete block having a plan view profile which substantially corresponds to said compartment;

applying adhesive to one of (1) the bottom surface of said preformed main concrete block and (2) the inner surface of said pan bottom wall;

positioning the preformed main concrete block into the compartment of the pan so that the bottom surface of the main concrete block contacts the pan bottom wall; and pressing the concrete block and pan together and allowing the adhesive at contact areas between the pan bottom wall and the bottom surface of the main concrete block to effect fixed securement of the main concrete block to and within the pan.

15. A process according to claim 14, wherein the first adhesive comprises a hot melt which is applied as an elongate bead to the respective edge surface, and wherein the second adhesive comprises an epoxy having a longer setting time but a higher bonding strength than the hot melt.

16. A process according to claim 15, wherein the adhesive which is applied to the bottom surface of the main block or the inner surface of the pan bottom wall is a hot melt so as to permit quick setting of the adhesive and fixed securement between the pan and main block.

17. A process according to claim 16, wherein the hot melt adhesive is applied to both the bottom surface of the block and to the upper surface of the pan bottom wall, prior to the pan and block being assembled and pressed together.

* * * * *